US012351361B2

(12) United States Patent
Fessler, Jr. et al.

(10) Patent No.: US 12,351,361 B2
(45) Date of Patent: Jul. 8, 2025

(54) RECONFIGURABLE CONTAINER SYSTEM

(71) Applicant: Summit Project, LLC, Chesterfield, MO (US)

(72) Inventors: Rick L. Fessler, Jr., Ballwin, MO (US); Timothy M. Bausch, Ballwin, MO (US)

( * ) Notice: Subject to any disclaimer, the term of this patent is extended or adjusted under 35 U.S.C. 154(b) by 197 days.

(21) Appl. No.: 17/864,600

(22) Filed: Jul. 14, 2022

(65) Prior Publication Data

US 2024/0017884 A1 Jan. 18, 2024

(51) Int. Cl.
*B65D 21/02* (2006.01)
*B65D 47/06* (2006.01)

(52) U.S. Cl.
CPC ..... *B65D 21/0231* (2013.01); *B65D 47/065* (2013.01)

(58) Field of Classification Search
CPC ..... B65D 21/0231; B65D 47/065; B65D 81/3205; B65D 21/0228; B65D 21/083; B65D 1/04; B65D 11/04; B65D 1/0246
USPC ..... 215/6
See application file for complete search history.

(56) References Cited

U.S. PATENT DOCUMENTS 928,002 A 7/1909 Paalen
2,099,174 A 11/1937 Payson
2,326,414 A 8/1943 Thompson
2,405,764 A 8/1946 Smith
2,711,766 A * 6/1955 Archer ..... A45D 40/0068 D9/504
2,836,323 A 5/1958 Robinson
3,067,896 A 12/1962 Berg
(Continued)

FOREIGN PATENT DOCUMENTS

CH 330424 A * 3/1955 ..... B65D 21/02
CH 667788 A5 * 3/1985 ..... A47G 19/03
(Continued)

OTHER PUBLICATIONS

ZULU Athletic webpage entitled, "Ace 24oz Vacuum Insulated Stainless Steel Water Bottle," downloaded Feb. 24, 2023 (https://www.zuluathletic.com/products/ace-24oz-vacuum-insulated-stainless-steel-water-bottle-with-removable-base?variant=41853131292856).
(Continued)

*Primary Examiner* — J. Gregory Pickett
*Assistant Examiner* — Niki M Eloshway
(74) *Attorney, Agent, or Firm* — David E. Crawford; Crawford I.P. Law

(57) ABSTRACT

A reconfigurable container system, including a bottle. The bottle includes an inner wall having an upper end defining a bottle opening, an outer wall having an upper end with a rim adjacent to a screw connector, and connector insert having a bayonet connector and a seal ring. The system includes a closure having an outer wall with a screw connector configured to releasably connect to the screw connector of the bottle to join the closure and the bottle. The closure includes a seal positioned to engage the bottle when the screw connectors of the bottle and closure connect to retain liquid in the bottle. The system includes a bottom canister having a bayonet connector configured to releasably connect to the bottle bayonet connector to selectively join the bottom canister and the bottle so the bottom canister sealingly engages the seal ring to retain contents in the bottom canister.

18 Claims, 21 Drawing Sheets

(56) References Cited

U.S. PATENT DOCUMENTS 3,076,575 A 2/1963 Leslie-Smith
3,143,205 A 8/1964 Ruderian
3,348,716 A 10/1967 Nakata
3,369,691 A * 2/1968 Wei ..... A47J 47/14 220/4.27
3,384,259 A 5/1968 Hoffstadt
3,945,496 A 3/1976 Gaetano
4,429,786 A * 2/1984 Hucal ..... A45C 11/005 220/4.27
5,086,926 A 2/1992 Paige
5,366,089 A 11/1994 Parker
5,535,889 A * 7/1996 Lin ..... A45C 11/20 206/547
6,145,685 A 11/2000 Dick
6,276,547 B1 * 8/2001 Petryna ..... B65D 21/083 220/4.03
6,945,416 B2 * 9/2005 Manno ..... B65D 71/502 206/217
7,798,346 B2 * 9/2010 Nelson ..... B65D 81/3205 220/23.6
7,914,165 B2 3/2011 Nelson
8,033,407 B2 * 10/2011 Minca ..... A47J 41/0072 220/592.16
8,146,758 B1 4/2012 Peres
8,342,346 B2 1/2013 Rances
8,727,157 B2 5/2014 Rances
9,016,488 B1 * 4/2015 Peres ..... A61J 9/008 215/11.1
9,120,598 B2 * 9/2015 Meyers ..... B65D 21/022
9,216,843 B2 * 12/2015 Sorensen ..... B65D 81/3205
9,278,781 B1 * 3/2016 Boldis ..... B65D 21/0231
9,743,803 B2 8/2017 Foster
9,950,827 B1 4/2018 Lau
10,427,825 B2 10/2019 Buehrle
D897,774 S * 10/2020 Pisarevsky ..... D7/532
2005/0218102 A1 * 10/2005 Guilford, III ..... A61J 9/00 215/11.1
2007/0017890 A1 * 1/2007 Al-Jadh ..... A61J 9/00 215/11.1
2007/0228038 A1 * 10/2007 Louis ..... B65D 21/083 220/4.26
2008/0035646 A1 2/2008 Smith
2009/0080180 A1 * 3/2009 Bertken ..... B65D 41/04 220/729
2009/0188884 A1 * 7/2009 Nelson ..... A61J 9/008 215/6
2010/0200438 A1 8/2010 Davies
2011/0186585 A1 * 8/2011 Lu ..... A47J 41/00 220/592.2
2011/0220605 A1 * 9/2011 Chapple ..... B65D 11/04 215/389
2012/0193316 A1 8/2012 Starks
2013/0111726 A1 5/2013 Krieger
2014/0048511 A1 * 2/2014 El-Saden ..... A47G 19/2266 215/389
2014/0238949 A1 * 8/2014 Patel ..... B65D 1/04 215/6
2015/0239600 A1 8/2015 Patel
2016/0257441 A1 * 9/2016 Brodwick ..... B65D 47/06
2017/0113836 A1 4/2017 Labedzki
2018/0141712 A1 * 5/2018 Hendricks ..... B65D 21/083
2018/0208361 A1 * 7/2018 Klein ..... B65D 21/0224
2021/0198006 A1 * 7/2021 Cohen ..... B65D 21/0231
2021/0368964 A1 * 12/2021 Bickford ..... A45D 40/0068
2021/0368966 A1 * 12/2021 Bickford ..... A45D 40/0068
2022/0388873 A1 * 12/2022 Guduru ..... B65D 47/065
2023/0202734 A1 * 6/2023 Abdelhamid ..... A24F 15/12 206/256
2023/0391504 A1 * 12/2023 Lull ..... B65D 43/0231

FOREIGN PATENT DOCUMENTS

CH 667788 A * 11/1988 ..... A47G 19/03
EP 1321370 A1 * 6/2003 ..... B29C 49/541
FR 1022625 A * 9/1949 ..... B65D 21/08
GB 2326150 A * 12/1998 ..... B65D 21/0231
GB 2454759 A * 5/2009 ..... A45F 3/16
WO WO-9204978 A1 * 9/1991 ..... A61B 10/0096
WO WO-2012000643 A1 * 1/2012 ..... A47G 19/23
WO WO-2017106201 A1 * 6/2017 ..... A45F 3/20

OTHER PUBLICATIONS

Trove Brands, LLC, Blenderbottle webpage entitled, "ProStak," downloaded Feb. 24, 2023 (https://www.blenderbottle.com/products/prostak?variant=23647093633).

* cited by examiner

RECONFIGURABLE CONTAINER SYSTEM

The present disclosure relates to refillable bottles and more particularly to a refillable bottle assembly having a plurality of containers adapted for use in different combinations and configurations.

Recognizing that hydration is important for general health, people frequently carry bottles containing liquids. These liquids include a broad range of beverages such as water, sports drinks, broths, smoothies, coffees, and teas. Environmental concerns surrounding disposable bottles have resulted in many people using refillable bottles. These bottles are adapted for periodic cleaning and repeated use. Frequently, refillable bottles have thermal insulation to maintain the temperature of liquids inside them for extended periods until consumed. Further, refillable bottles often have features intended to facilitate carrying the bottles while users move from place to place. These conveniences enhance the desirability and usefulness of conventional refillable bottles.

Refillable bottles are particularly useful when exercising and during outdoor activities. When participating in these activities, users frequently dress in activity-specific clothing without provisions for carrying items such as keys, identification, cash, snacks, medicines, or powdered drink mixes. Although some bottles include means for separately carrying liquid and other items, on occasion users need to store carry more than one item separately from each other. For example, a hiker may wish to carry loose snacks and cash. Placing the cash in the same container as the loose snacks would allow bacteria on the cash to contaminate the loose snacks. Thus, there remains a need for a bottle having provisions for segregating stored items from each other and from a liquid in the bottle.

Depending on the particular activity and circumstances, the user may want to carry the items without carrying a liquid or vice versa. Although a container system having both a bottle and a separable container could be used in both instances, carrying unused containers adds weight and increases bulk. Therefore, there is a need for a system allowing parts of the system to be used independently. Likewise, there is a need for a system allowing containers and bottles of differing sizes to be used in selected combinations and configurations to optimize the system for particular activities and circumstances.

SUMMARY OF THE INVENTION

In one aspect, the present disclosure includes a reconfigurable container system, comprising a bottle. The bottle includes a bottle inner wall having a bottle inner wall upper end defining a bottle opening and a bottle inner wall lower end opposite the bottle inner wall upper end. The bottle also includes a bottle bottom wall extending across the bottle inner wall lower end such that the bottle inner wall and the bottle bottom wall define a bottle hollow interior adapted to hold liquid. Further, the bottle includes a bottle outer wall spaced from the bottle inner wall including a bottle outer wall upper end having a circular rim adjacent to a bottle screw connector element and a bottle outer wall lower end opposite the bottle outer wall upper end. The bottle outer wall lower end extends below the bottle inner wall lower end to define a space below the bottle bottom wall. In addition, the bottle includes a bottle outer retainer mounted in the space below the bottle bottom wall and spaced from the bottle bottom wall. The bottle also includes a bottle inner retainer mounted inside the bottle outer retainer and a bottle connector insert mounted below the bottle inner retainer.

The bottle connector insert includes a bottle connector insert interior surface having a bottle bayonet connector element and a bottle connector insert downward-facing surface having an annular seal ring. The reconfigurable container system also comprise a closure including a closure outer wall having a closure screw connector element configured to releasably connect to the bottle screw connector element to selectively join the closure and the bottle. The closure also includes a seal positioned to engage the bottle outer wall upper end when the closure screw connector element connects to the bottle screw connector element to block the bottle opening so as to retain liquid in the bottle hollow interior. Further, the reconfigurable container system comprises a bottom canister including a bottom canister collar having a bottom canister collar inner surface defining a bottom canister mouth. The bottom canister also includes a bottom canister collar outer surface facing opposite the bottom canister collar inner surface and a bottom canister hollow interior accessible through the bottom canister mouth and adapted for holding contents. The bottom canister includes a bottom canister bayonet connector element positioned on the bottom canister collar outer surface and configured to releasably connect to the bottle bayonet connector element to selectively join the bottom canister and the bottle such that the bottom canister sealingly engages the annular seal ring on the bottle so as to retain contents in the bottom canister hollow interior.

In another aspect, the present disclosure includes a reconfigurable container system, comprising a thermally insulated bottle. The bottle includes a plurality of walls, a hollow bottle interior adapted to hold liquid therein, an outward-facing bottle screw connector element adjacent to a bottle upper end, and an inward-facing bottle bayonet connector element. The system further comprises a closure including an inward-facing closure screw connector element configured to releasably interlock with the outward-facing bottle screw connector element to selectively connect the closure to the bottle and a seal positioned to engage the bottle when the inward-facing closure screw connector element interlocks with the outward-facing bottle screw connector element to retain liquid in the bottle hollow interior. In addition, the system includes an intermediate canister having an intermediate canister hollow interior and an outward-facing intermediate canister upper bayonet connector element configured to releasably interlock with the inward-facing bottle bayonet connector element to selectively join the intermediate canister and the bottle to retain contents in the intermediate canister hollow interior. The intermediate canister also includes an inward-facing lower bayonet connector element. Moreover, the system includes a bottom canister having a bottom canister hollow interior, a bottom canister collar defining a bottom canister circular mouth, and an outward-facing bottom canister bayonet connector element. This bottom canister bayonet connector element is configured to releasably interlock with the inward-facing bottle bayonet connector element to selectively join the bottom canister and the bottle to retain contents in the bottom canister hollow interior and to releasably interlock with the inward-facing intermediate canister lower bayonet connector element to selectively join the bottom canister and the intermediate canister to retain contents in the bottom canister hollow interior. The system further comprises a cap including an inward-facing cap bayonet connector element configured to releasably interlock with the outward-facing bottom canister bayonet connector element to selectively join the cap and the bottom canister to retain contents in the bottom canister hollow interior and to releasably interlock with the outward-facing intermediate canister upper bayonet connector element to selectively join the cap and the intermediate canister to retain contents in the intermediate canister hollow interior. The cap and bottom canister are adapted for use without the bottle, the closure, and the intermediate canister. The cap, the intermediate canister, and the bottom canister are adapted for use without the bottle and the closure. The bottle, the closure, the intermediate canister, and the bottom canister are adapted for use without the cap. And the bottle, the closure, and the bottom canister are adapted for use without the intermediate canister and the cap.

Additionally, the present disclosure includes a reconfigurable container system, comprising a bottle including an upper end defining a bottle opening, a first connector element adjacent to the upper end, a lower end opposite the upper end, a second connector element adjacent to the lower end, and a hollow bottle interior accessible via the bottle opening and adapted to hold liquid. The system also comprises a wide-mouth closure configured to releasably interlock with the first connector element to selectively connect the wide-mouth closure to the bottle to retain liquid in the bottle. Further, the system comprises a wide-and-narrow-mouth closure including a wide-mouth portion configured to releasably interlock with the first connector element to selectively connect the wide-mouth portion to the bottle. The wide-mouth portion has a narrow mouth for accessing liquid in the bottle when the wide-mouth portion is connected to the bottle. The wide-and-narrow-mouth closure includes a cover configured to selectively block the narrow mouth of the wide-mouth portion to retain liquid in the bottle. In addition, the system comprises a stowable straw closure configured to releasably interlock with the first connector element to selectively connect the stowable straw closure to the bottle to retain liquid in the bottle. The stowable straw closure includes a cylindrical straw extending from outside the hollow bottle interior to a location adjacent to a bottom of the hollow bottle interior to selectively draw liquid from the hollow bottle interior. The system further comprises a canister having an upper end and a third connector element adjacent to the upper end of the canister configured to releasably interlock with the second connector to selectively connect the bottle and the canister.

The present disclosure also includes a reconfigurable container system, comprising a bottle having an inward-facing fastener element adjacent to a bottle lower end. Additionally, the system comprises a first intermediate canister having an outward-facing fastener element adjacent to a first canister upper end adapted to selectively interlock with the inward-facing fastener element adjacent to the bottle lower end to connect the first intermediate canister to the bottle. The first intermediate canister also has an inward-facing fastener element adjacent to a first canister lower end. In addition, the system comprises a second intermediate canister having an outward-facing fastener element adjacent to a second canister upper end adapted to selectively interlock with the inward-facing fastener element adjacent to the first canister lower end to connect the second intermediate canister to the first intermediate canister. The second intermediate canister has an inward-facing fastener element adjacent to a second canister lower end. Further, the system comprises a bottom canister having an outward-facing fastener element adjacent to a bottom canister upper end adapted to selectively interlock with the inward-facing fastener element adjacent to the second canister lower end to connect the bottom canister to the second intermediate canister.

Other aspects of the present disclosure will be apparent in view of the following description and claims.

BRIEF DESCRIPTION OF DRAWINGS

Corresponding reference characters indicate corresponding parts throughout the drawings.

DETAILED DESCRIPTION

Figure 1:
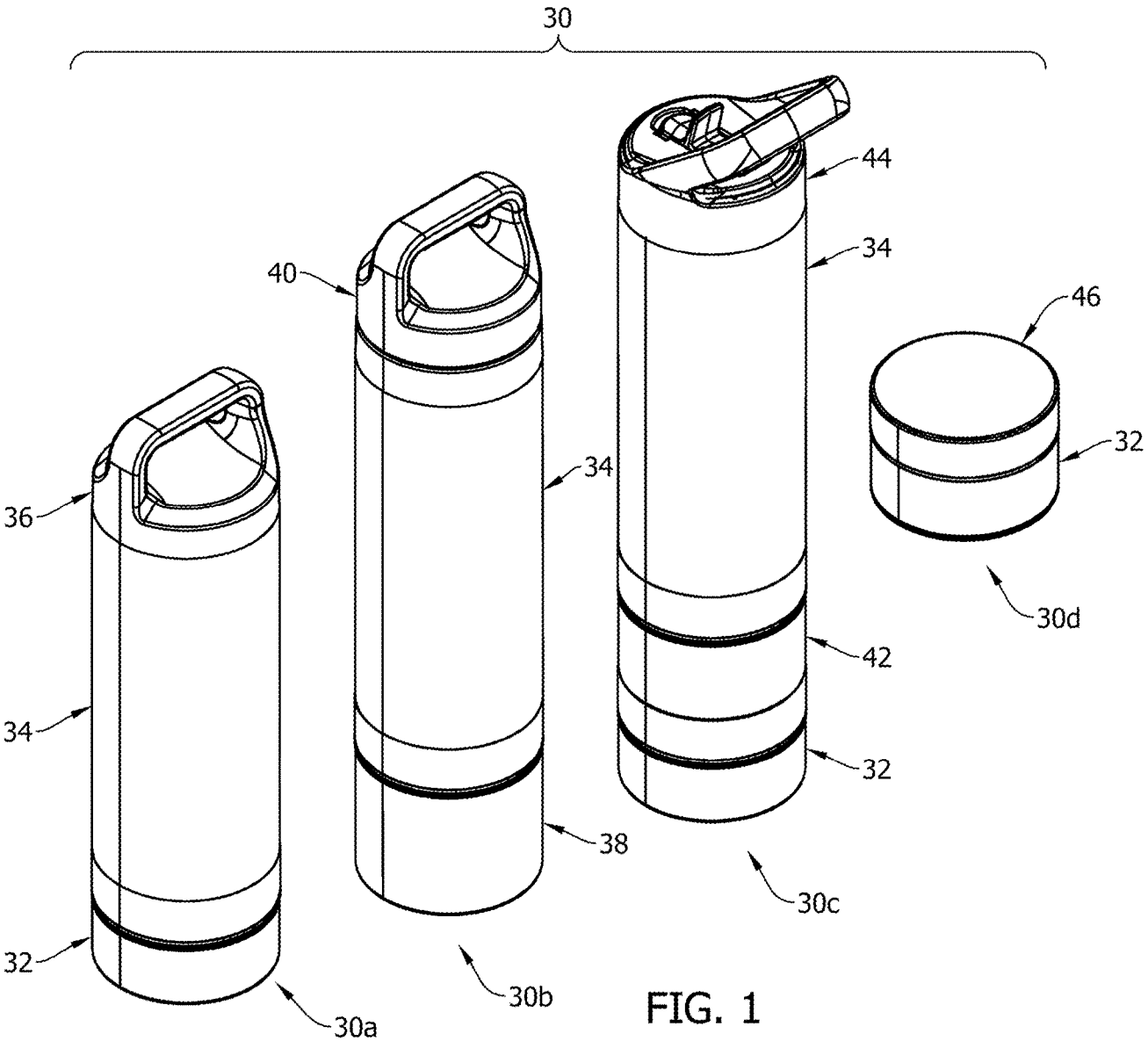
FIG. 1 is a perspective of a reconfigurable container system showing exemplary alternative combinations and configurations thereof.

Referring to the drawings and more particularly to FIG. 1, an example of a reconfigurable container system is collectively designated by the reference number 30. The system 30 permits the alternative use of two or more components comprising a bottom canister or container (generally designated by 32), a bottle or container (generally designated by 34), a wide-mouth closure (generally designated by 36), an elongated bottom canister or container (generally designated by 38), a wide-and-narrow-mouth closure (generally designated by 40), an intermediate canister or container (generally designated by 42), a stowable straw closure (generally designated by 44), and a canister cap or closure (generally designated by 46). The reconfigurable container system 30 may be used in a plurality of combinations and configurations including those illustrated in FIG. 1 (designated generally by 30*a*, 30*b*, 30*c*, and 30*d*) and in a multiplicity of other combinations and configurations as will be apparent from this disclosure.

Figure 2:
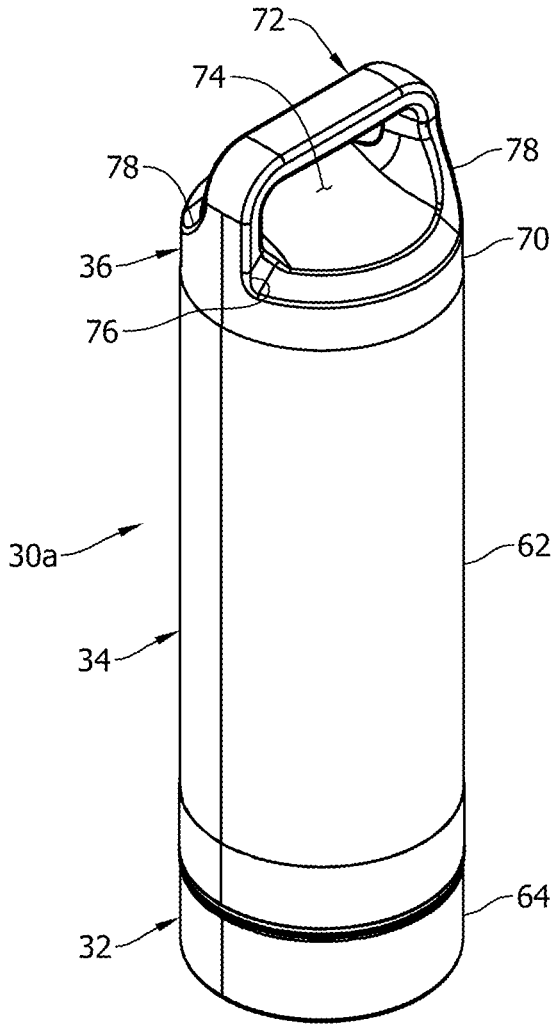
FIG. 2 is an assembled perspective showing a first exemplary combination and configuration of the reconfigurable container system.
Figure 3:
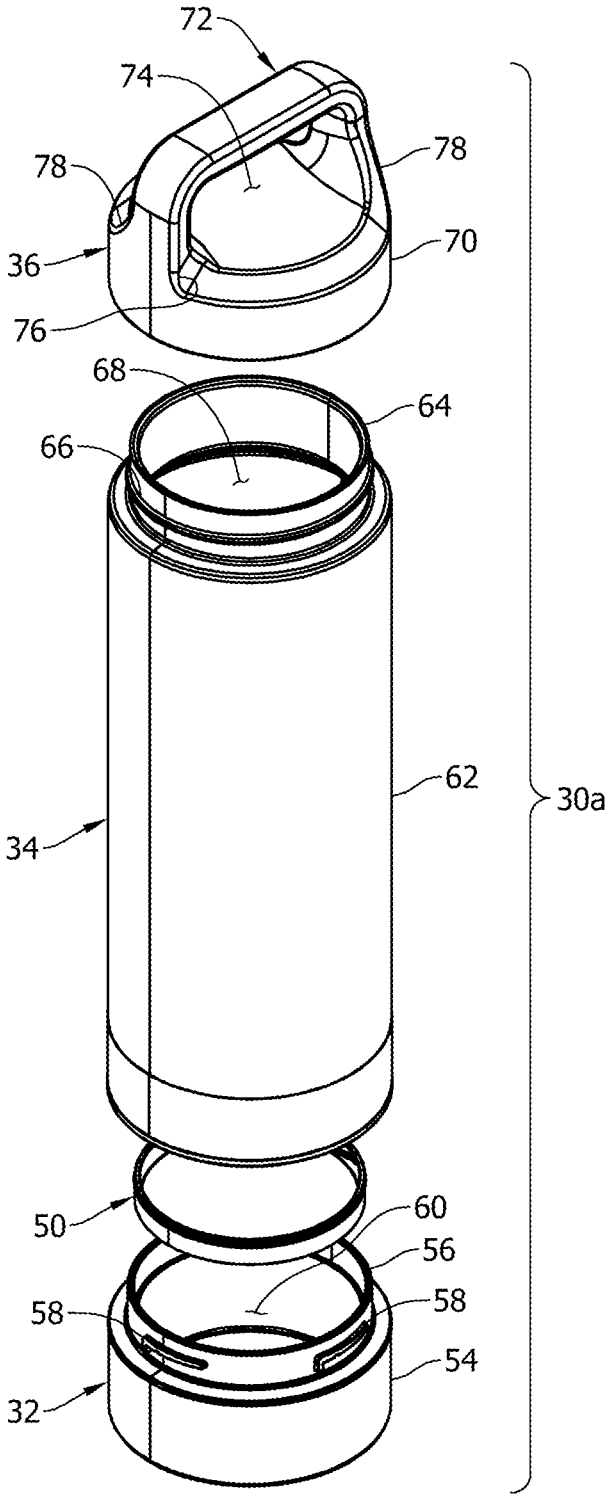
FIG. 3 is a separated perspective of the first exemplary combination and configuration.
Figure 4:
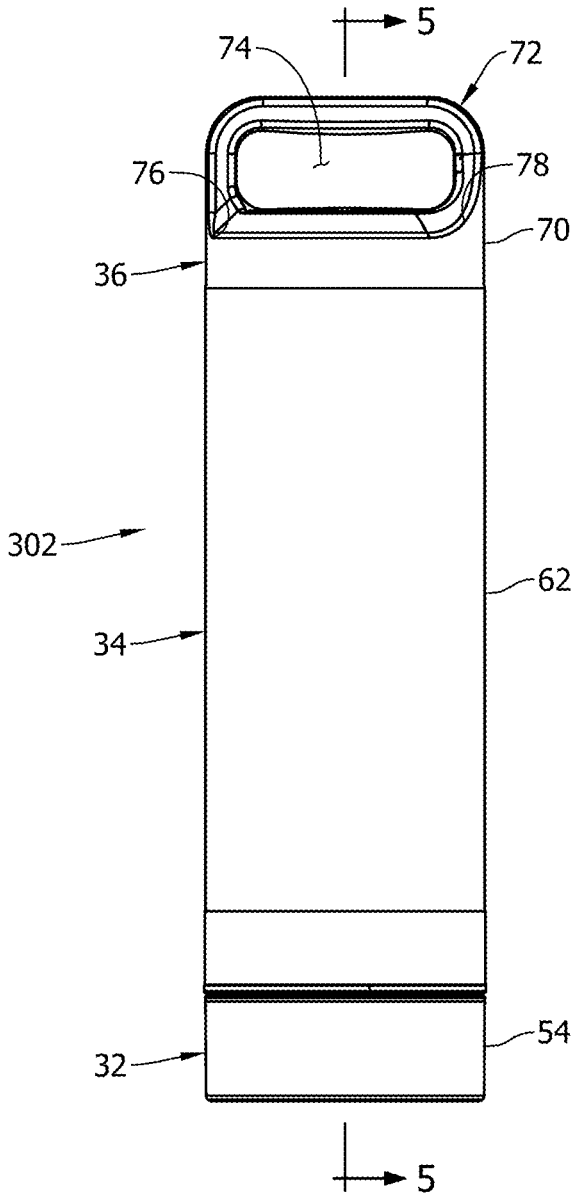
FIG. 4 is a front elevation of the first exemplary combination and configuration.

FIGS. 2 and 3 illustrate a first exemplary combination and configuration 30*a* of the container system 30. FIG. 2 illustrates the first example 30 in a connected configuration and FIG. 3 illustrates the first example in a separated configuration. The first example 30*a* consists of the bottom canister 32, the bottle 34, and the wide-mouth closure 36. As shown in FIG. 3, the bottom canister 32 may be used with an optional lid or closure, generally designated by 50, to segregate the contents of the canister from the bottom surfaces of an adjacent system component connected above the bottom canister (e.g., bottle 34). The bottom canister 32 has a generally cylindrical exterior surface 54 having a predetermined diameter, a narrower neck 56 featuring a connector element 58 for selectively connecting the bottom canister to the bottle 34, and a hollow interior 60 for holding a variety of user-selected contents such as keys, ear pods, snacks, tablets, capsules, powders, and creams. As will be appreciated, the listed contents are exemplary and should not be interpreted as limiting the capabilities of the bottom canister 32. As will also be appreciated, the connector element 58 may include spaced bayonet connectors as shown or other conventional connectors including screw connectors and detents. Although the illustrated bottom canister 36 has four equally spaced bayonet connectors 58, other quantities of bayonet connectors are envisioned. The bottle 34 has a generally cylindrical exterior surface 62 having a diameter corresponding to that of the bottom canister 32, a narrower neck 64 having a connector element 66 for selectively connecting the bottle to a selected closure (e.g., wide-mouth closure 36), and a hollow interior 68 for holding contents including fluids (e.g., water) or soluble powders. As will be appreciated, the listed contents are exemplary and should not be interpreted as limiting. As should also be appreciated, the connector element 66 may include a single screw thread connector as shown or other conventional connectors. The wide-mouth closure 36 shown in FIGS. 4 and 5 has a generally cylindrical cover portion 70 having a diameter matching those of the bottom canister 32 and bottle 34, and a bail or handle, generally designated by 72, having a rounded rectangular opening 74. As further illustrated in FIGS. 2-5, smaller and larger fillets 76, 78, respectively, are provided where the handle 72 meets the cover portion 70 of the wide-mouth closure 36. The smaller fillets 76 face counter-clockwise and the larger fillets 78 face clockwise. The different fillet sizes provide an aesthetically pleasing appearance. As will be appreciated, the handle 72 provides a grip for rotating the wide-mouth closure 36 relative to the bottle 34 when removing the closure from the bottle to access its contents and for connecting the closure to the bottle to retain the contents in the bottle. The rounded rectangular opening 74 is sized and shaped for holding the container system 30 with a finger (e.g., an index finger and a middle finger) or for suspending the container system with a conventional keeper such as a clip, clasp, hook, or cord.

Figure 5:
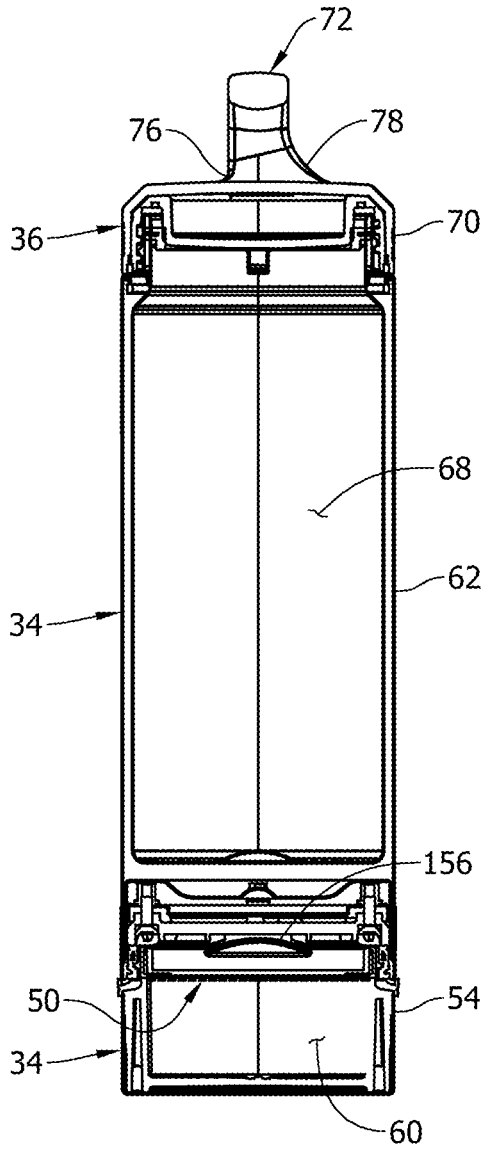
FIG. 5 is a cross section of the first exemplary combination and configuration taken in the plane of line 5-5 of FIG. 4.
Figure 6:
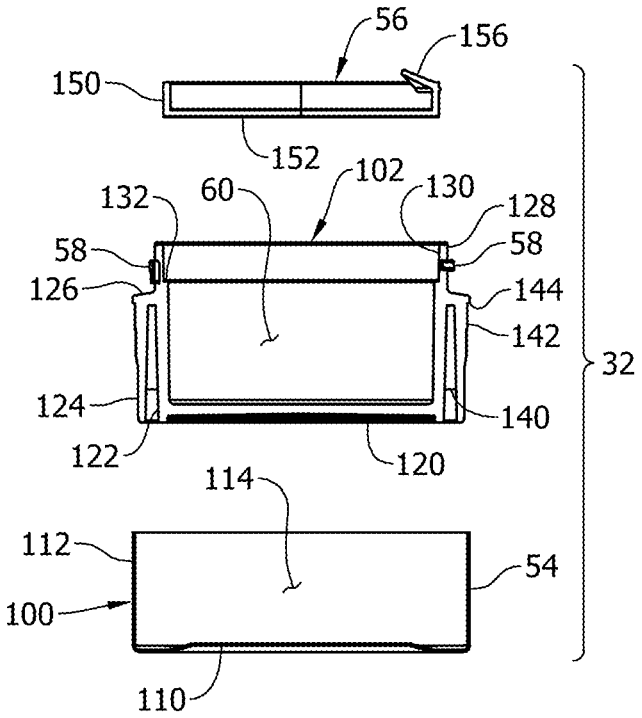
FIG. 6 is a separated cross section of a bottom canister of the reconfigurable container system.
Figure 7:
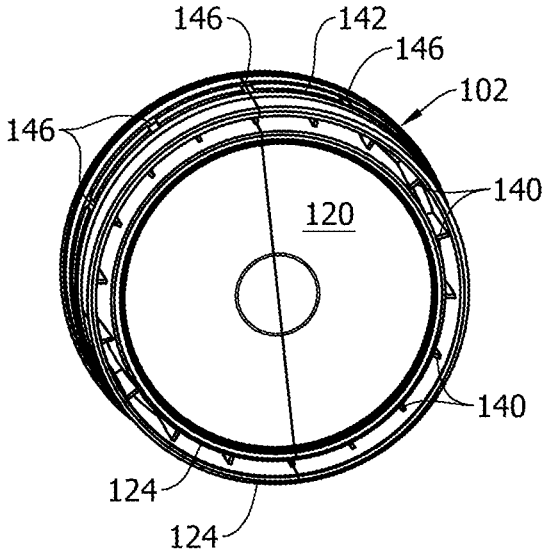
FIG. 7 is a perspective of a liner of the bottom canister.

FIGS. 5 and 6 show elements of the bottom canister 32, including a bottom canister shell, generally designated by 100, and a bottom canister liner, generally designated by 102. The bottom canister shell 100 includes a shell bottom wall 110, forming a bottom of the first exemplary container system assemblage 30*a*, and a shell sidewall 112 extending upward from the periphery of the bottom wall. The bottom wall 110 and sidewall 112 define a liner receiving space 114 sized and shaped for receiving a portion of the bottom canister liner 102. The exterior surface of the sidewall 112 forms the generally cylindrical exterior surface 54 of the bottom canister 32. As illustrated in FIGS. 5-7, the bottom canister liner 102 includes a liner bottom wall 120, a liner interior sidewall 122, and a liner exterior sidewall 124 spaced from the interior sidewall by an annular connecting flange 126. In the illustrated example, the interior sidewall 122 extends below the bottom wall 120, providing a cavity after assembly between the bottom wall 110 of the bottom canister shell 100 and the bottom wall 120 of the bottom canister liner 102. As will be appreciated, the cavities between the interior sidewall 122 and the exterior sidewall 124 and between the liner bottom wall 120 and the shell bottom wall 110 provide thermal and auditory insulation between the hollow interior 50 of the bottom canister and ambient surroundings. Thus, heated or chilled contents in the bottom canister 32 can maintain their temperature over a longer period. Further, should contents in the bottom canister 32 be shaken any resulting noise will be attenuated outside the canister.

The interior sidewall 122 and bottom wall 110 of the bottom canister liner 102 define the hollow interior 50 of the bottom canister 32. A collar 128 having a generally cylindrical mouth 130 extends upward from the flange 126 to form the neck 56 of the bottom canister 32. In the illustrated example, the mouth 130 is radially offset from the inner sidewall 122 to provide a seat 132 for the lid 50. As shown in FIG. 7, the canister liner 102 further comprises circumferentially spaced gussets 140 extending downwardly from the connecting flange 126 between the interior sidewall 122 and the exterior sidewall 124 to provide support for the walls. Although the illustrated example shows eighteen equally spaced gussets 140, it is envisioned the canister liner 102 may have fewer or more gussets of equal or differing heights in equal or unequal spacings. The exterior sidewall 124 of the bottom canister liner 102 has a tapering stepped exterior surface 142 sized and shaped to join the shell 100 and liner with a close press fit so they resist separating after assembly. An annular ledge 144 extends outward from the exterior sidewall 124 immediately above the tapering exterior surface 142 to provide a seat that the shell engages when assembled to the bottom canister liner 102. An intermediate step on the exterior surface 142 of the exterior sidewall 124 has equally circumferentially spaced flat lands 146, providing openings between the liner 102 and shell 100 during assembly to vent excess air between the liner and shell when the liner is pressed into the shell. The illustrated liner 102 has twelve flat lands 146, but it is envisioned the liner may have other numbers of lands. Although the bottom canister shell may be formed from other materials, the shell 100 of the illustrated example is formed from SUS304 stainless steel sheet. As will be appreciated, the shell 100 may have surface finishes and treatments including a powder coat to improve the appearance and feel of the bottom canister 32. The bottom canister liner 102 of the illustrated example is injection molded polypropylene, but it is envisioned it may be made from other materials and by other processes.

As shown in FIGS. 5 and 6, the optional lid 50 includes a short cylindrical sidewall 150 and a bottom wall 152. As will be appreciated, the sidewall 150 is sized and shaped to be received in the mouth 130 of the bottom canister liner 102. An annular ridge 154 is provided on the sidewall 150 to provide a snug fit capable of holding the lid in the mouth 130 of the bottom canister during use. A tab 156 extends inward from the sidewall 150 of the lid 50 to facilitate removing the lid from the bottom canister 32 to allow access to the hollow interior 50. As will be appreciated, the sidewalls provide a short space that the user may use to hold small items (e.g., a tea bag or loose key) separately from the hollow interior 50 of the canister. Although the lid may be formed from other materials using other processes, the lid 50 of the illustrated example is molded from translucent polyethylene.

Figure 8:
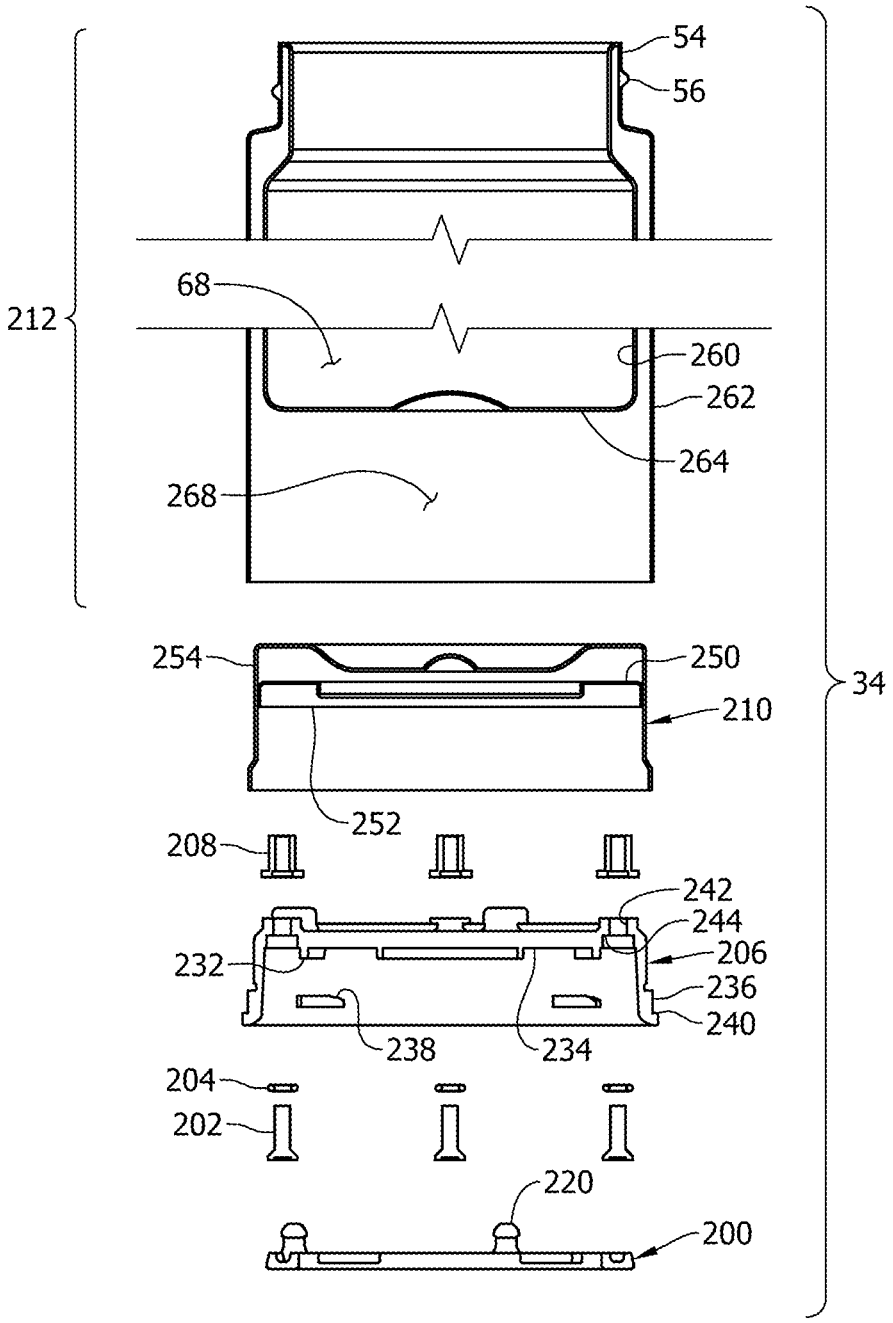
FIG. 8 is a fragmentary separated cross section of a bottle of the reconfigurable container system.
Figure 9:
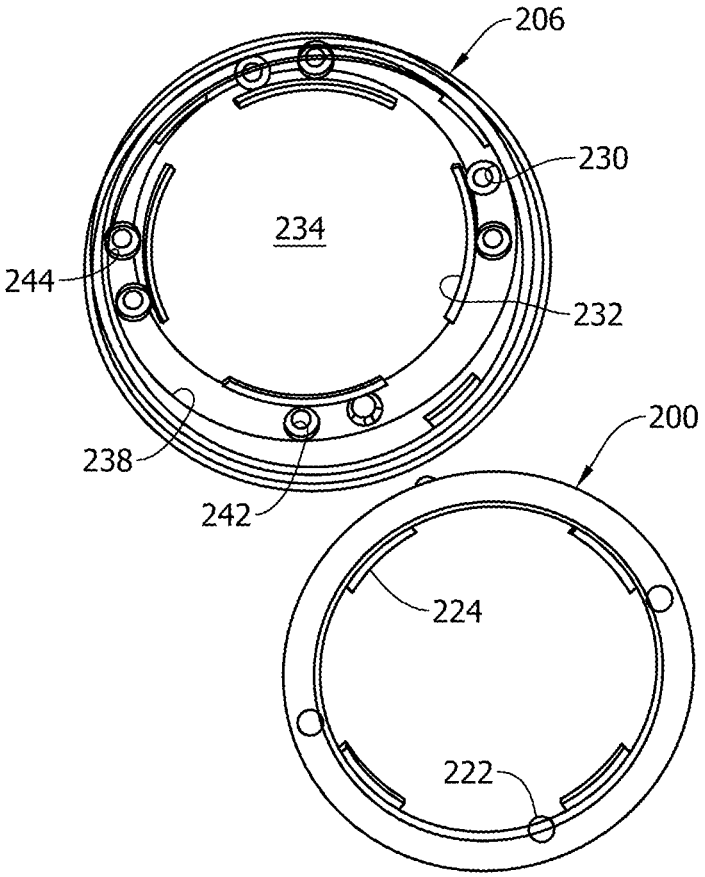
FIG. 9 is a separated perspective of an annular seal ring and a connector insert of the bottle.
Figure 10:
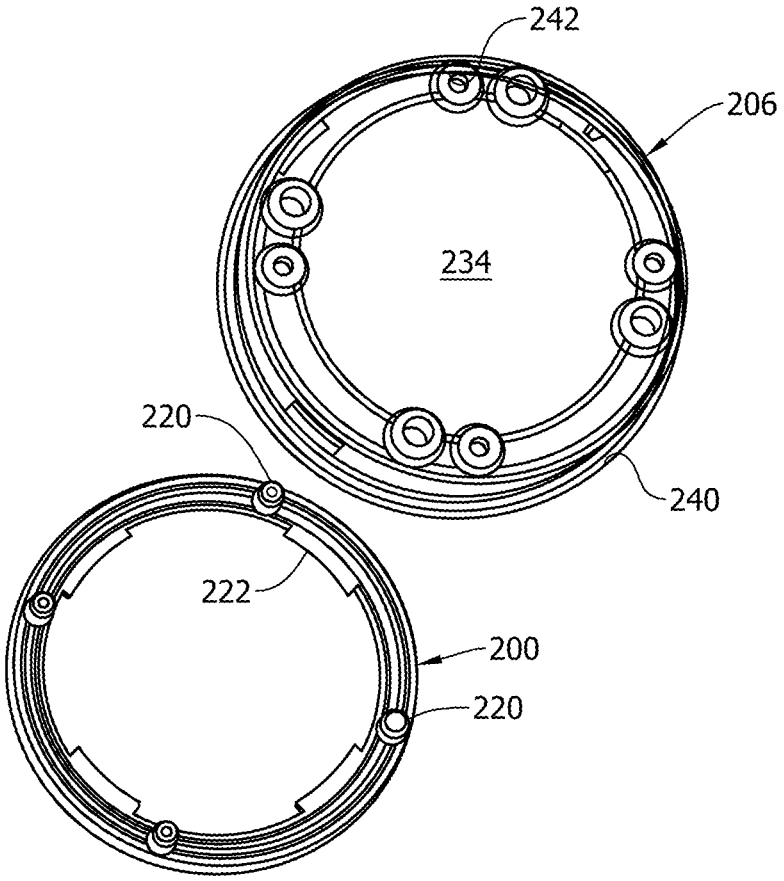
FIG. 10 is an alternative separated perspective of the annular seal ring and the connector insert of the bottle.

FIG. 8 shows elements of the bottle 34, including an annular seal ring, generally designated by 200, flat head cap screws 202, O-rings or seals 204, a connector insert, generally designated by 206, deform nuts or self-retaining nuts 208, a retainer assembly 210, and a double-walled tank, generally designated by 212. The seal ring 200 is made from a suitable food-safe elastomeric material (e.g., white translucent silicone) and has a U-shaped cross section, allowing the seal ring to deform to seal with the bottom canister 32 (or another selected component of the container system 30). As shown in FIGS. 9 and 10, the seal ring 200 includes four connector plugs 220 extending upward from an upper surface of the ring and four lugs 222 extending radially inward from an inner surface of the ring. Sockets 230 provided in the connector insert 206 receive the plugs 220 to hold the ring seal 200 in position in the connector insert. Further, the lugs 222 of the seal ring 200 fit between arcuate lands 232 extending downward from a top wall 234 of the connector insert 206 to prevent the seal ring from rotating inside the connector insert. The arcuate lands 232 also center the seal ring 200 in the connector insert 206. A sidewall 236 extends downward from the top wall 234, and a connector element 238 is provided on the interior surface of the sidewall. This connector element 238 is configured to releasably engage the connector element 58 provided on the neck 56 of the canister 32 (or another selected component of the container system). The sidewall 236 includes a flange 240 extending outward adjacent to its lower end, providing a seat that lower edges of the retainer assembly 210 and tank 212 engage during assembly. Four equally spaced openings 242 are provided through the top wall 234 for receiving the cap screws 202. Further, the openings 242 include a recessed spot face 244 for accommodating the O-rings 204 positioned on the cap screws. The deform nuts 208, which receive the cap screws 202, are inserted into four equally spaced openings 250 formed in an inner retainer 252 of the retainer assembly 210. As the screws 202 are tightened, the deform nuts 206 expand as shown in FIG. 5 to retain the nuts in position in the openings 250 of the inner retainer 252. Although the screws 202 and nuts 206 may have other driver configurations, in one example these components include Allen sockets adapted to receive Allen wrenches. The inner retainer 252 is pressed inside an outer retainer 254 of the retainer assembly 210 to fasten the connector insert 206 to the retainer assembly 210. Once the connector insert 206 is fastened to the retainer assembly 210, the seal ring 200 is installed by pushing the plugs 220 of the seal ring are pushed into the sockets 230 in the connector insert to hold the seal ring in position covering the cap screws 202. Although the connector insert may be made from other materials, the connector insert 206 of the illustrated example is injection molded from polypropylene.

As shown in FIG. 8, the tank 212 has a double-wall construction comprising an inner wall 260 and an outer wall 262. The inner wall 260 and a bottom wall 264 of the tank 212 define the hollow interior 58 of the bottle 34. An upper end of the inner wall 260 forms a generally cylindrical mouth 266 to provide access to the hollow interior 58 of the bottle 34. As illustrated in FIG. 8, the outer wall 262 extends downward below the bottom wall 264 of the tank 212 providing a space 268 for receiving the retainer assembly 210, the connector insert 206, and the seal ring 200 during assembly. The upper ends of the inner and outer walls 260, 262, respectively, have reduced diameters to form the narrower neck 54 of the bottle 34. The connector element 56 (e.g., a screw thread) is formed on the exterior of the outer wall 262 at the neck 54. Although the retainer and tank may be made from other materials, the retainer assembly 210 and tank 212 of the illustrated example are formed from SUS304 stainless steel sheet. The tank 212 may be formed using conventional techniques. For example, the tank 212 may be formed as several pieces and joined (e.g., welded) to facilitate manufacturing. As will be appreciated, a space formed between the walls of the tank 212 enhances the thermal insulation properties of the bottle 34 so fluid in the hollow interior 58 of the bottle 34 maintains its temperature for a longer period than it would in a single wall metal bottle. In some examples, the tank 212 is sized to hold twelve, sixteen, or twenty-four fluid ounces, but it is envisioned the tank may have other volumes. In some examples, the volume is adjusted by changing the length of the tank 212 rather than changing the diameter. FIG. 8 includes parting lines indicating the tank may have any practical length.

Figure 11:
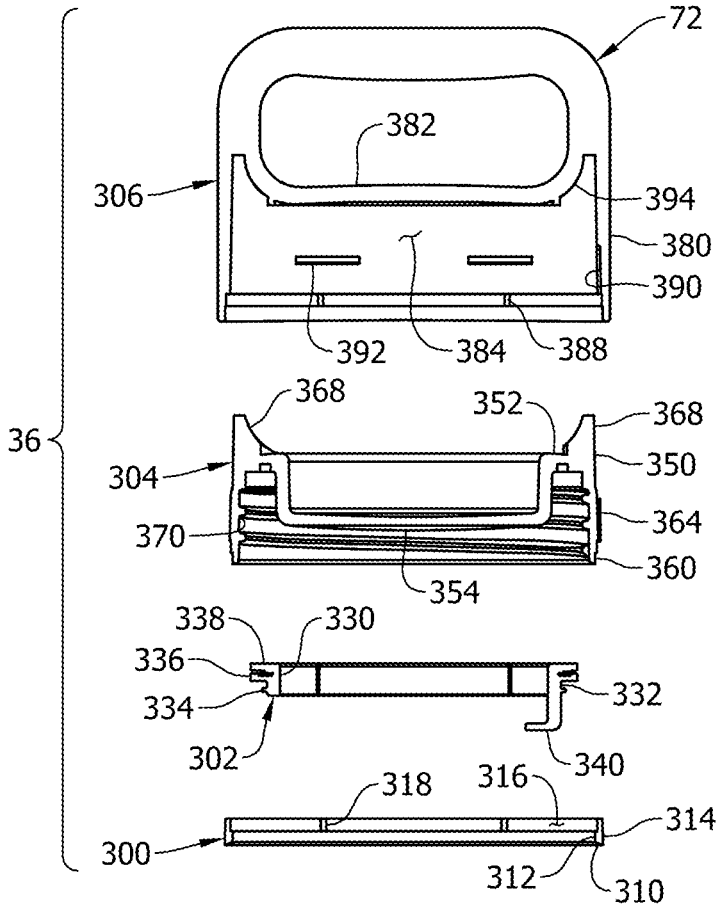
FIG. 11 is a separated cross section of a wide-mouth closure of the reconfigurable container system.
Figure 12:
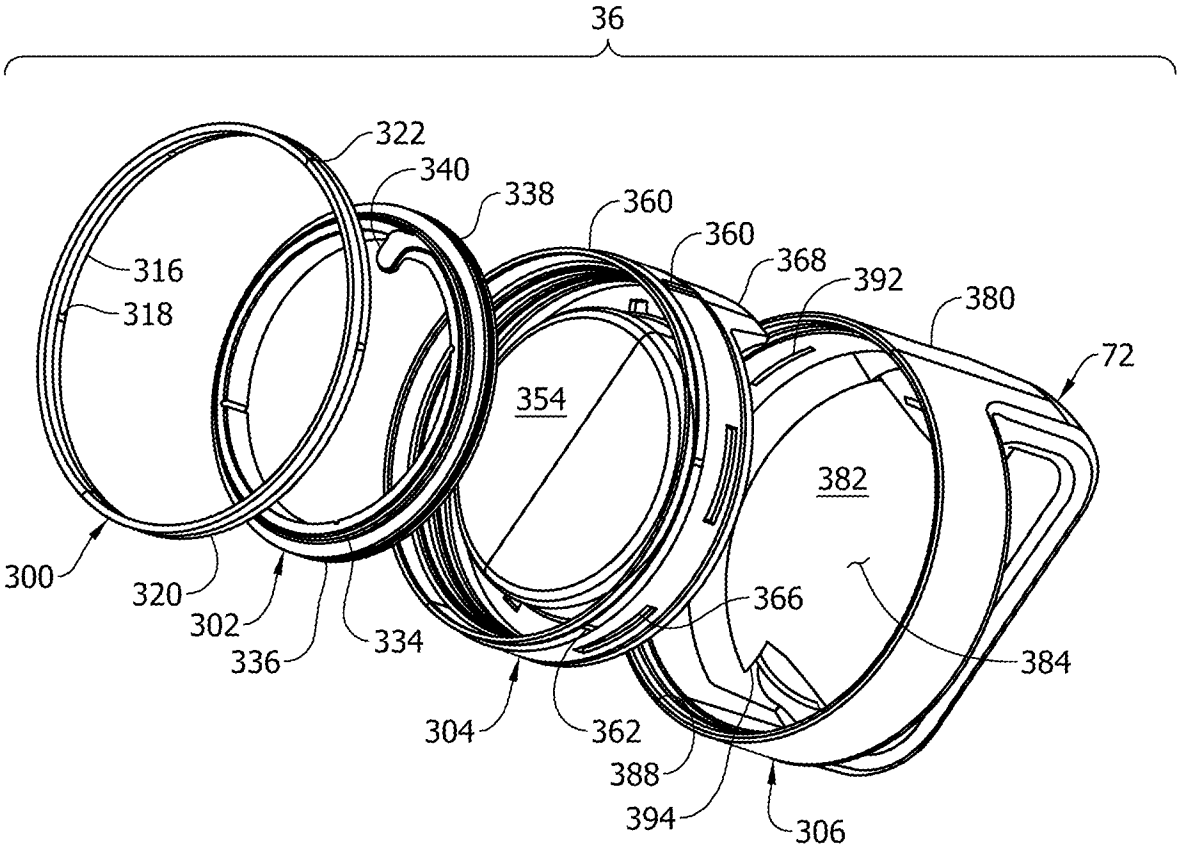
FIG. 12 is a separated perspective of the wide mouth closure.

FIGS. 11 and 12 illustrate elements of the wide-mouth closure 36, including a rim, generally designated by 300, a seal, generally designated by 302, a connector insert, generally designated by 304, and an outer cover, generally designated by 306. The rim 300 includes a tapered lower face 310 to facilitate positioning the closure 36 on the bottle 34, as well as an inner surface 312, and an outer surface 314. The inner surface 312 includes an increased diameter portion 316 at its upper end matching a corresponding surface on the connector insert 304 and equally spaced bosses 318 extending inward from the increased diameter portion. Although the illustrated rim 300 has six bosses 318, it is envisioned the rim may have other quantities. The outer surface 314 includes a reduced diameter portion 320 at its upper end matching a corresponding surface on the cover 306 and equally spaced bosses 322 extending outward from the reduced diameter portion. The illustrated rim 300 is injection molded polypropylene, but it is envisioned the rim may be made using other processes and materials.

The seal 302 has an interior surface 330 and an opposite exterior surface 332. A circumferential rib 334 and spaced seal flanges 336, 338 extend outward from the exterior surface 332 of the seal 302. Further, a pull tab 340 extends downward from the seal 302 for removing the seal from the closure 36 for cleaning or replacement. In addition, the pull tab 340 may be shaped as shown to conform to the adjacent surface of the connector insert 304 after assembly. As will be appreciated, the interior surface 330 and seal flanges 336, 338 are sized so the seal 302 must be pressed into the connector insert. Moreover, the rib 334 is sized to engage an inside surface of the neck 54 of the bottle 34 when the bottle and closure 36 are connected and the lower seal flange 336 is spaced from the upper seal flange 338, allowing the lower flange to deflect upward so the interface between the bottle and closure is fluid-tight. Although the seal may be made of other food-safe elastomers, the seal 302 of the illustrated example is made from white translucent silicone.

As further shown in FIG. 11, the connector insert 304 has a sidewall 350, an annular top wall 352, and a central hub 354 depending downward from the top wall. As shown in FIG. 12, an outer surface of the sidewall 350 includes a lower rim 360 having a reduced outer diameter matching the inside surface 312 of the rim 300, and spaced channels 362 for accommodating the bosses 318 on the rim. As will be appreciated, when the bosses 318 and channels 362 are aligned and the rim 300 is pressed onto the connector insert 304, the bosses engage the channels, preventing the rim from rotating relative to the insert. As further illustrated in FIGS. 11 and 12, the outer surface of the sidewall 350 includes an axial ridge 364 extending upward above one of the channels 362 to orient the insert 304 and cover 306 as will be explained. FIG. 12 also shows the outer surface of the sidewall 350 includes spaced grooves 366. Although the grooves 366 may be spaced at other intervals, in the illustrated example, two of the grooves are centered about 60° from opposite sides of the axial ridge 364 and two grooves are centered about 120° from opposite sides of the axial ridge. Two ears 368 extend upward from the top wall 352. One ear 368 is circumferentially aligned with the axial ridge 364 and the other ear is positioned opposite the first as shown. A connector element 370 corresponding to the connector element 58 on the bottle 34 is provided on the sidewall 350 to connect the closure 36 to the bottle 34 during use. Although the connector insert may be made of other materials, the connector insert 304 of the illustrated example is made from injection-molded polypropylene.

The outer cover 306 includes a sidewall 380 and a top wall 382 defining an insert receiving space 384. The handle 72 of the closure 36 extends upward from the sidewall 380 and top wall 382. The sidewall 380 includes a stepped inner surface having diameters corresponding to the outer surface 314 of the rim 300. Channels 388 are provided in the inner surface of the sidewall 380 to receive the bosses 322 extending outward from the outer side 314 of the rim 300. As will be appreciated, when the bosses 322 and channels 388 are aligned and the rim 300 is pressed into the cover 306, the bosses engage the channels preventing the rim from rotating relative to the cover. An axial groove 390 extends upward along the inner surface of the sidewall 380 for receiving the axial ridge 364 of the connector insert 304 to ensure the insert is oriented properly with the cover during assembly. The inner surface of the sidewall 380 has spaced ridges 392 configured to engage the spaced grooves 366 in the connector insert 304 to fasten the connector insert and cover together to prevent disassembly during use. Two pockets 394 extend upward into the handle 72 from the top wall 382. One pocket 394 is circumferentially aligned with the axial groove 390 and the other pocket is positioned opposite the first as shown. The pockets 394 receive the ears 368 when the connector insert 304 is fastened to the cover 306 to ensure the cover and insert are rotationally locked together. The illustrated cover 306 is injection molded polypropylene, but it is envisioned it may be made from other materials.

To assemble the closure 36, the axial ridge 364 on the connector insert 304 is aligned with the axial groove 390 in the cover 306, and the insert is pressed into the insert receiving space 384 until the spaced ridges 392 on the cover 306 snap into the spaced grooves 366 in the connector insert, thereby locking the insert in the insert receiving space of the cover. Once the cover 306 and insert 304 are connected, the rim 300 is oriented so its inner bosses 318 are aligned with the channels 362 in the insert and the outer bosses 322 are aligned with the channels 388 in the cover 306. The rim 300 is pressed into position between the cover 306 and insert 304. Once positioned, the bosses and channels prevent the rim from rotating relative to the cover 306 and the connector insert 304. As will be appreciated, the rim 300 and cover 306 have a close diametral fit to prevent inadvertent removal to the rim once inserted in the cover. The seal 302 is pushed into the connector insert 304 as previously explained.

In use, a selected item may be inserted in the hollow interior 58 of the bottom canister 32 and the lid 50 may be optionally pushed into the canister before connecting the bottom canister 32 to the bottle 34. The closure 36 may be disconnected from the bottle 34 to fill the hollow interior 58 of the bottle before reconnecting the closure to the bottle. When the user wants access to the contents of either the bottle 34 or bottom canister 32, the component holding the desired contents may be disconnected from the component above it without disconnecting other connected components.

Figure 13:
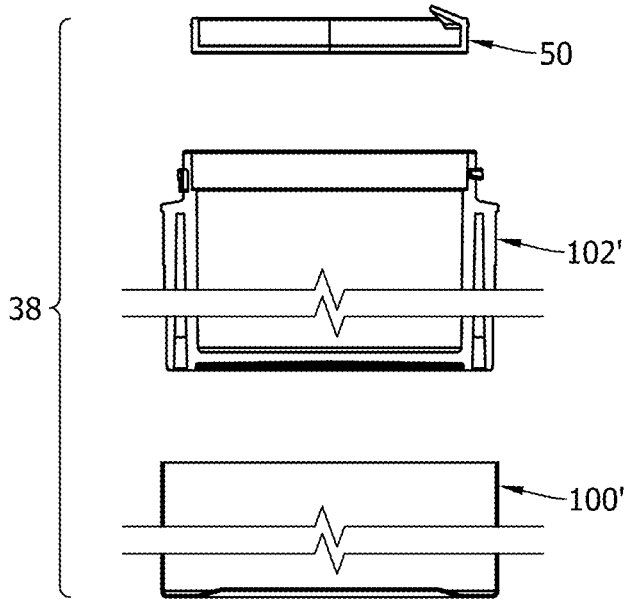
FIG. 13 is a fragmentary separated cross section of an elongated bottom canister.

As further illustrated in FIG. 1, a second exemplary configuration and combination 30*b* of the container system 30 comprises the elongated bottom canister 38, the bottle 34, and the wide-and-narrow-mouth closure 40. FIG. 13 shows a fragmentary cross section of the elongated bottom canister 38. The elongated bottom canister 38 is similar to the bottom canister 32 of the first exemplary configuration and combination 30*a* except that the shell 100' and insert 102' are elongated as indicated by parting lines to lengths different from those of the previously described bottom canister 32. Although the elongated canister 38 may have any practical length, it is envisioned that the elongated canister could be offered with shell lengths that are multiples of the bottom canister shell 100 to provide an aesthetically pleasing appearance. For example, the elongated canister may have a shell that is two times, three times, or four times the length of the shell 100 of the previously described bottom canister 32. The inert 102' is lengthened by a corresponding amount. The elongated bottom canister 38 may be used in combination with the optional lid 50 described with respect to the previous example.

Figure 14:
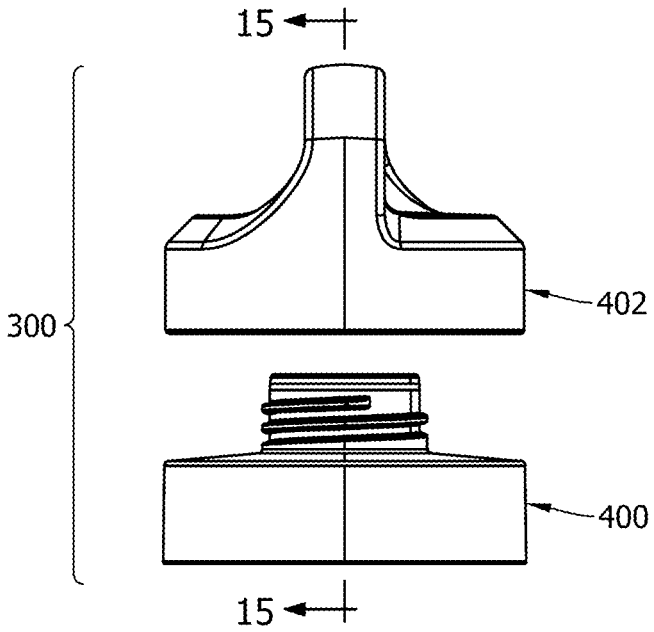
FIG. 14 is an elevation of a wide-and-narrow-mouth closure separated into a lower closure part and an upper closure part.
Figure 15:
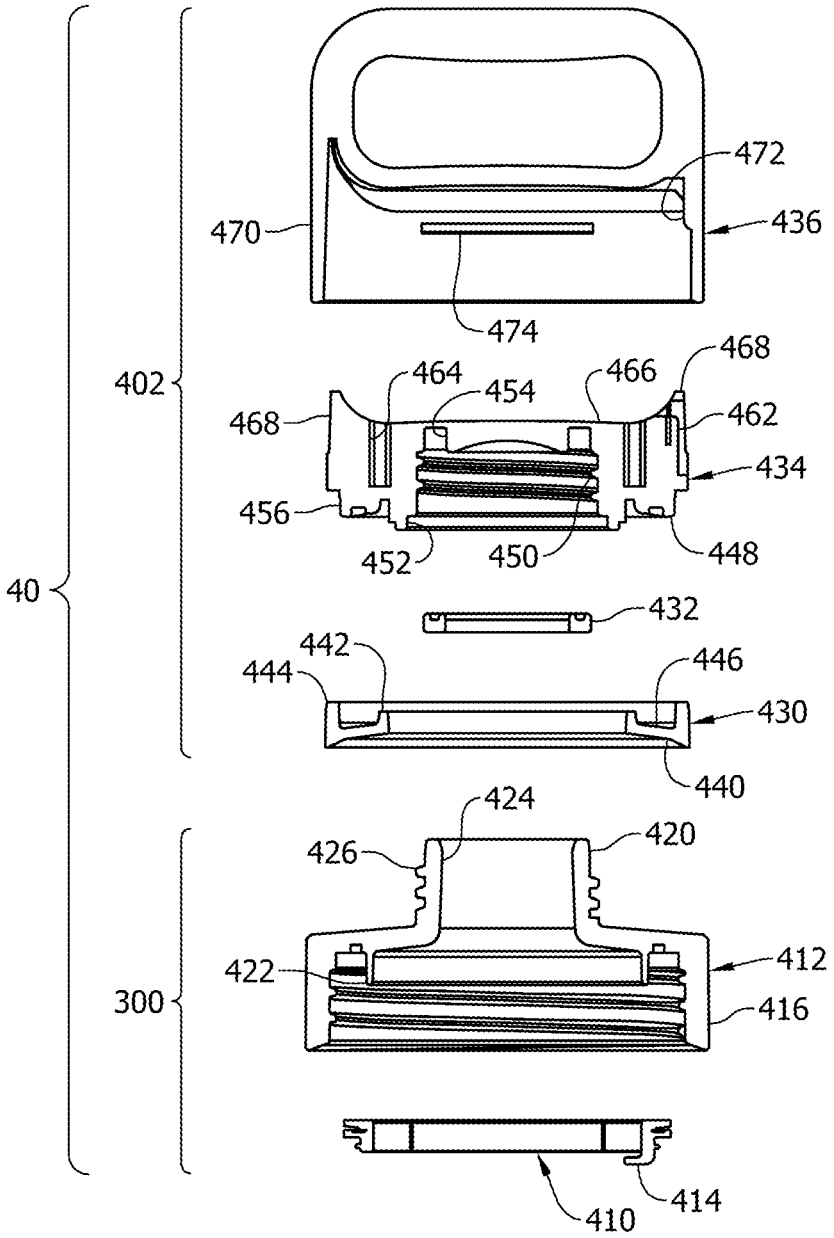
FIG. 15 is a separated cross section of the wide-and-narrow-mouth closure taken in the plane of line 15-15 of FIG. 14.

FIG. 14 shows a separated wide-and-narrow-mouth closure 30 comprising a lower closure, generally designated by 400, and an upper closure generally designated by 402. As will be appreciated, once the bottle 34 is filled with fluid, the wide-mouth closure 400 may be attached to the bottle 34 to provide a narrow mouth through which a user may drink. The narrow-mouth closure 402 may be attached to the wide-mouth closure to retain the fluid in the bottle 34. As shown in FIG. 15, the lower closure 400 consists of a seal, generally designated by 410, and a lower cover, generally designated by 412. The seal 410 is similar to the seal 302 of the wide-mouth closure 36 except for the shape of the pull tab 414. The lower cover 412 includes a lower sidewall 416, a top wall 418, and an upper sidewall 420. The interior of the lower sidewall 416 is identical to the sidewall 350 of the connector insert 304 of the wide-mouth closure 36. Instead of a central hub 344, the lower closure 400 includes an inner sidewall 422 sized for holding the seal 410. The upper wall 420 extends upward from the top wall 418 and includes a narrow-mouth opening 424 that extends through the top wall. A connector element 426 is provided on an exterior surface of the upper wall for selectively connecting the upper closure 402 to the lower closure 400. The connector element 426 may include a single thread screw connector as shown or other conventional connectors. The lower closure 400 is assembled by pressing the seal 410 into the lower cover 412.

Figure 16:
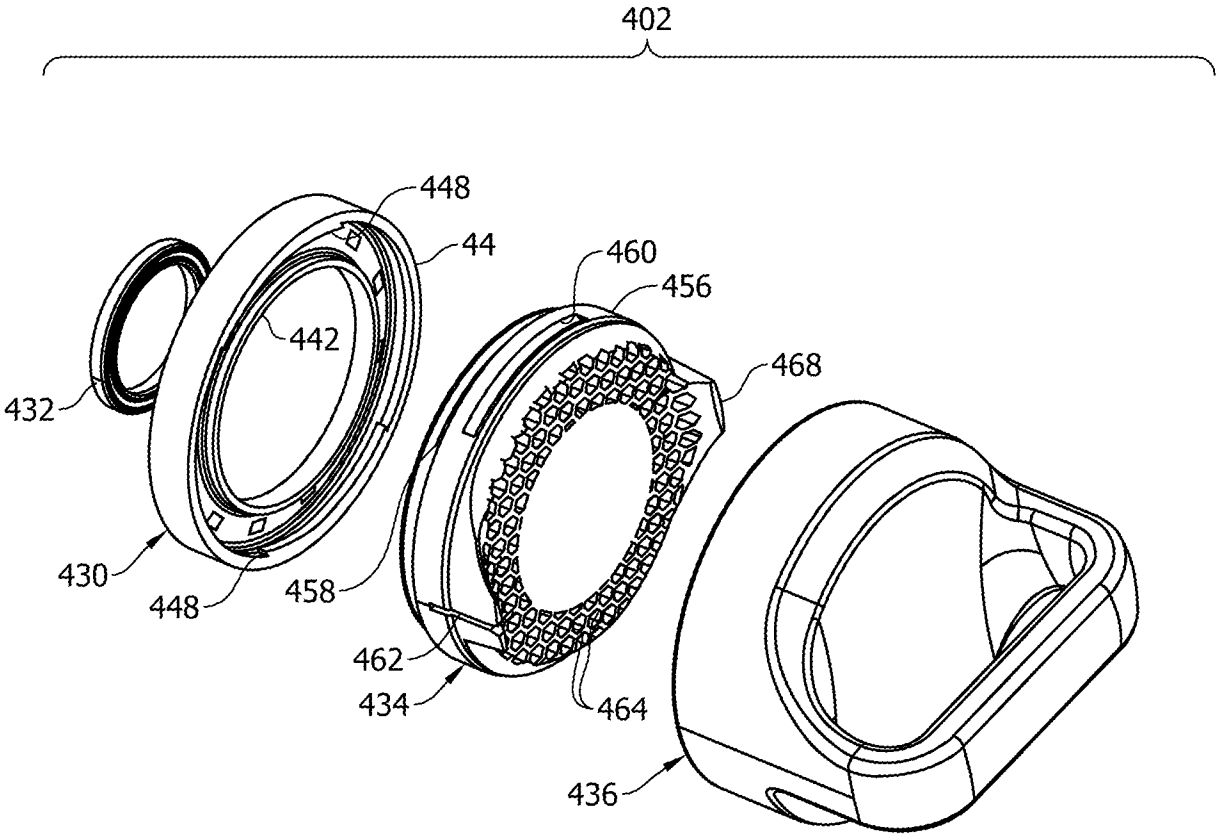
FIG. 16 is a separated perspective of the upper closure part.
Figure 17:
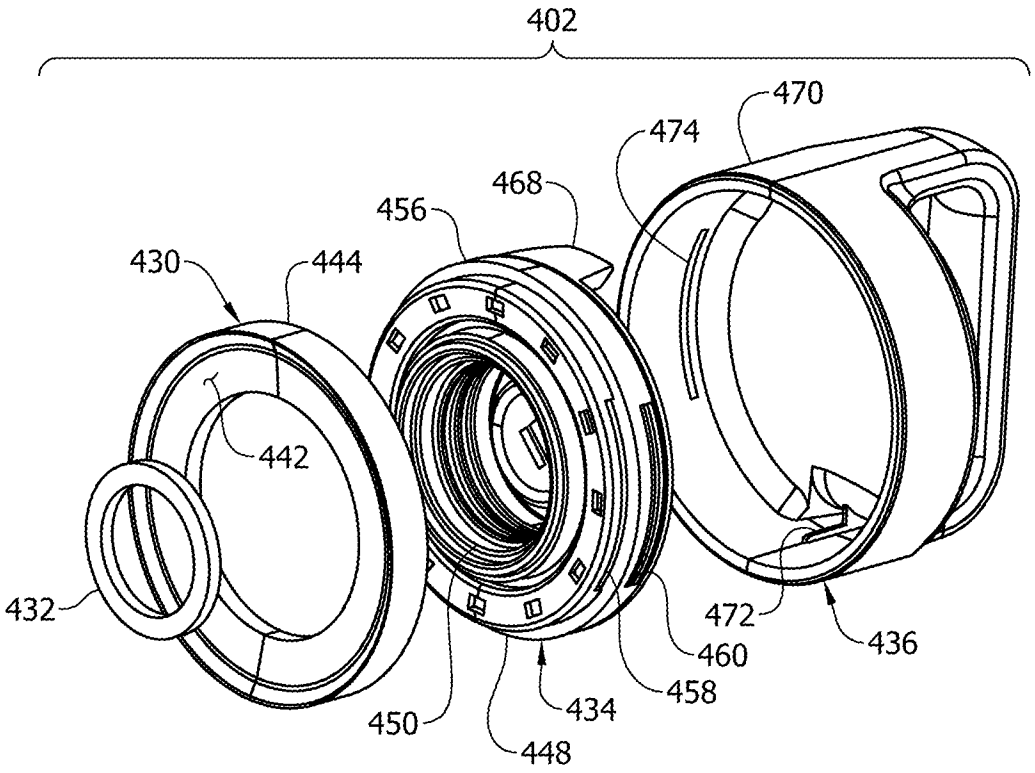
FIG. 17 is another separated perspective of the upper closure part.

As illustrated in FIGS. 15-17, elements of the upper, narrow-mouth closure 402 include a rim, generally designated by 430, a ring seal 432, a connector insert, generally designated by 434, and a cover, generally designated by 436. The rim 430 includes a tapered lower face 440 to facilitate centering the upper closure 402 on the narrow mouth 424 of the lower closure 400, as well as an inner wall 442, an outer wall 444, and an upper face 446. The inner and outer walls 442, 444, respectively, extend above the upper face 446. As shown in FIG. 15, opposing arcuate flanges 448 extend inward from the upper end of the outer wall 444. Although the rim may be made using other processes and materials, the illustrated rim 430 is injection molded polypropylene. The ring seal 432 is similar to that of the wide-mouth closure 36 except that it has a smaller diameter corresponding to the narrow mouth 424 of the lower closure 400. The connector insert 434 has a lower surface 448 including a portion shaped to match the rim 430. A connector element 450 configured to connect with the connector element 426 of the lower closure 400 is provided on an inner surface 452 of the insert 434. An annular channel 454 extending upward immediately above the connector element 450 is configurated to receive the ring seal 432 and hold it in position for engaging the lower closure 400. An outside surface 456 of the connector insert 434 has lower opposing arcuate grooves 458 adapted to receive the arcuate flanges 448 extending inward from the outer wall 444 of the rim 430 to fasten the elements together. The outer surface 456 also has upper arcuate grooves 460 and an axial groove 462. As further illustrated in FIG. 16, hexagonal openings 464 extend downward from an upper surface 466 of the connector inert 434 to reduce material requirements. Opposite ears 468 extend upward from opposite sides of the upper surface 466 similar to the ears 368 provided on the connector insert 304 of the wide-mouth connector 36. Although the connector insert may be made using other processes and materials, the illustrated connector insert 434 is injection molded polypropylene. The cover 436 includes many of the same features described with respect to the cover 306 of the wide-mouth closure 36. The cover 436 includes a sidewall 470 having an axial ridge 472 and opposite arcuate bosses 474 extending from its inner surface. The ridge 472 ensures the cover 436 and connector insert 434 are properly oriented during assembly, and the bosses 474 engage the arcuate grooves 460 in the connector insert during assembly to prevent the elements from being disassembled. The cover 436 is made from injection-molded polypropylene but it is envisioned it may be made from other materials using other processes. As the features of the elements of the narrow-to-wide-mouth closure are similar to those of the wide-mouth closure, the narrow-to-wide mouth closure will not be described in further detail.

Figure 18:
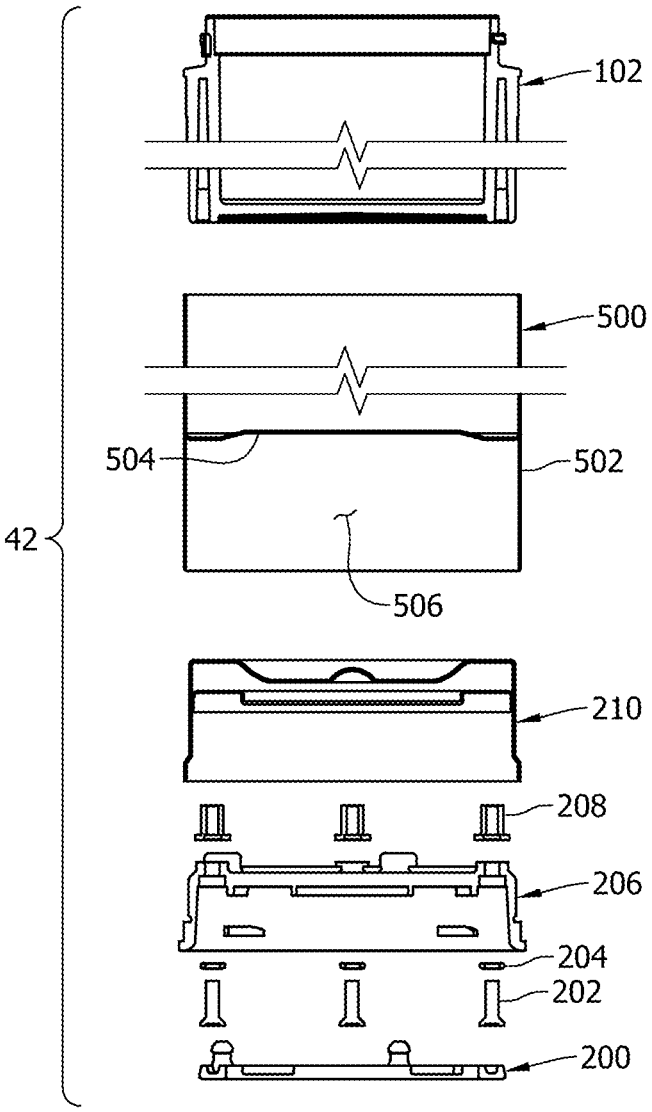
FIG. 18 is a fragmentary separated cross section of an intermediate canister.

As further illustrated in FIG. 1, a third exemplary configuration and combination 30*c* of the container system 30 consists of the bottom canister 32, an intermediate canister 42, the bottle 34, and the stowable straw closure 44. The bottom canister 32 and bottle 34 are identical to those previously described. FIG. 18 shows a cross section of the intermediate canister 42. The intermediate canister 42 comprises an annular seal ring, generally designated by 200, flat head cap screws 202, O-rings 204, a connector insert, generally designated by 206, deform nuts 208, and a retainer assembly 210 identical to those previously described with respect to the bottle 34, and a liner 102 that is identical to that of the bottom canister 32. Accordingly, these elements will not be described in further detail. The intermediate canister 42 also includes a shell, generally designated by 500, that is similar to the shell 100 of the bottom canister 32 except the intermediate canister shell has a collar 502 extending downward below the bottom wall 504 forming a space 506 for receiving the retainer assembly 210 during assembly. As other features of the intermediate canister 42 are similar to those of the previously described bottom canister 32 and bottle 34, they will not be described further.

Figure 19:
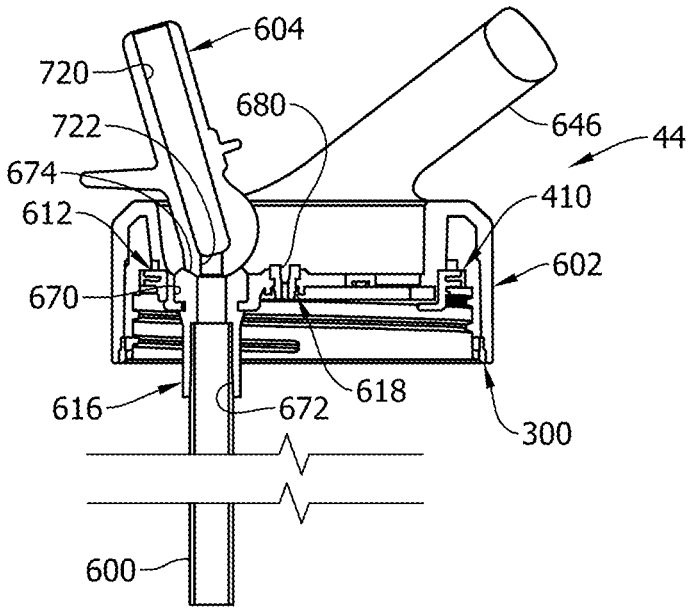
FIG. 19 is a cross section of a stowable straw closure having a spout in an open position.
Figure 20:
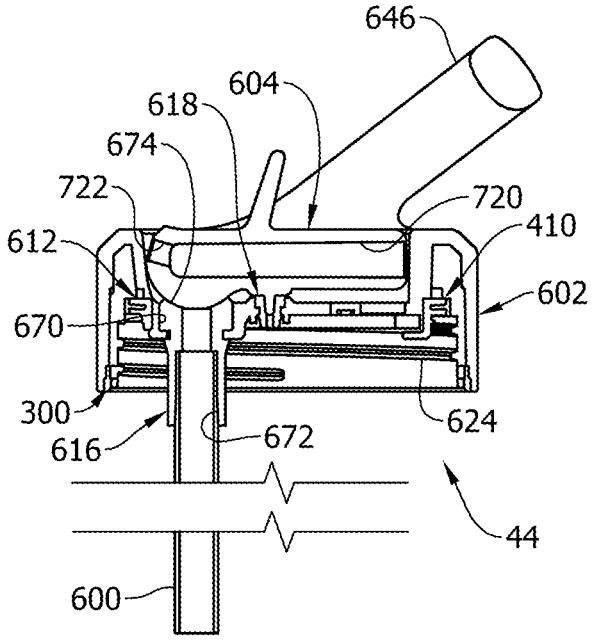
FIG. 20 is a cross section of the stowable straw closure having the spout in a closed position.

FIGS. 19 and 20 illustrate the stowable straw closure 44 in open and closed positions, respectively. The straw closure 44 generally comprises a straw 600, a head, generally designated by 602, and a pivotable spout, generally designated by 604. As will be appreciated the straw 600 extends from the head to a lower end adjacent to the bottom of the tank 208 permitting liquid to be drawn from the bottom of the tank during use. When in the open position, the spout 604 is pivoted upward so passages in the spout are in fluid communication with the straw 600, allowing liquid to a user through the spout. When in the closed position, the spout 604 is pivoted downward so passages in the spout are not in fluid communication with the straw 600, preventing liquid from leaking from the bottle 34 through the spout.

Figure 21:
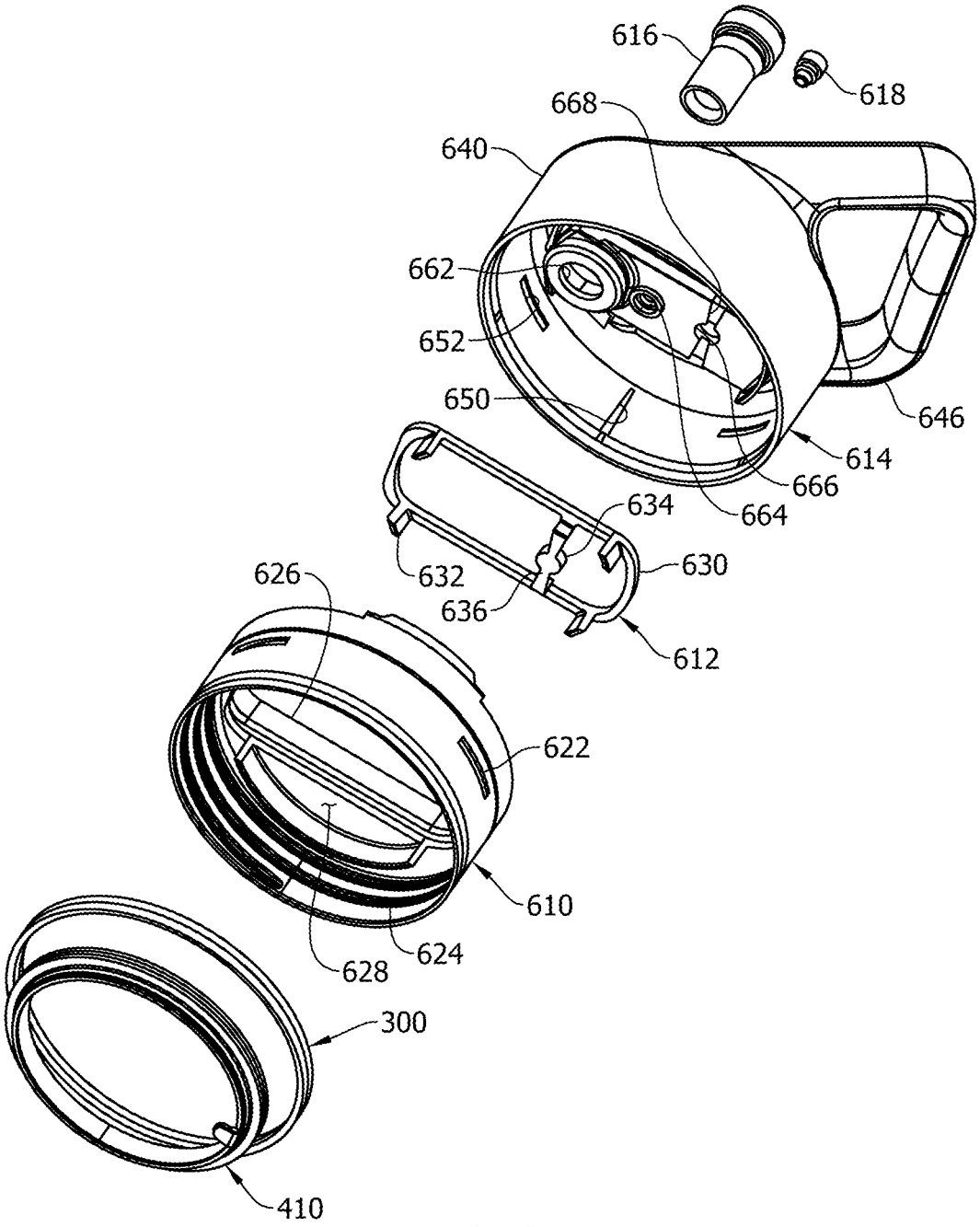
FIG. 21 is a separated perspective of a head of the stowable straw closure.
Figure 22:
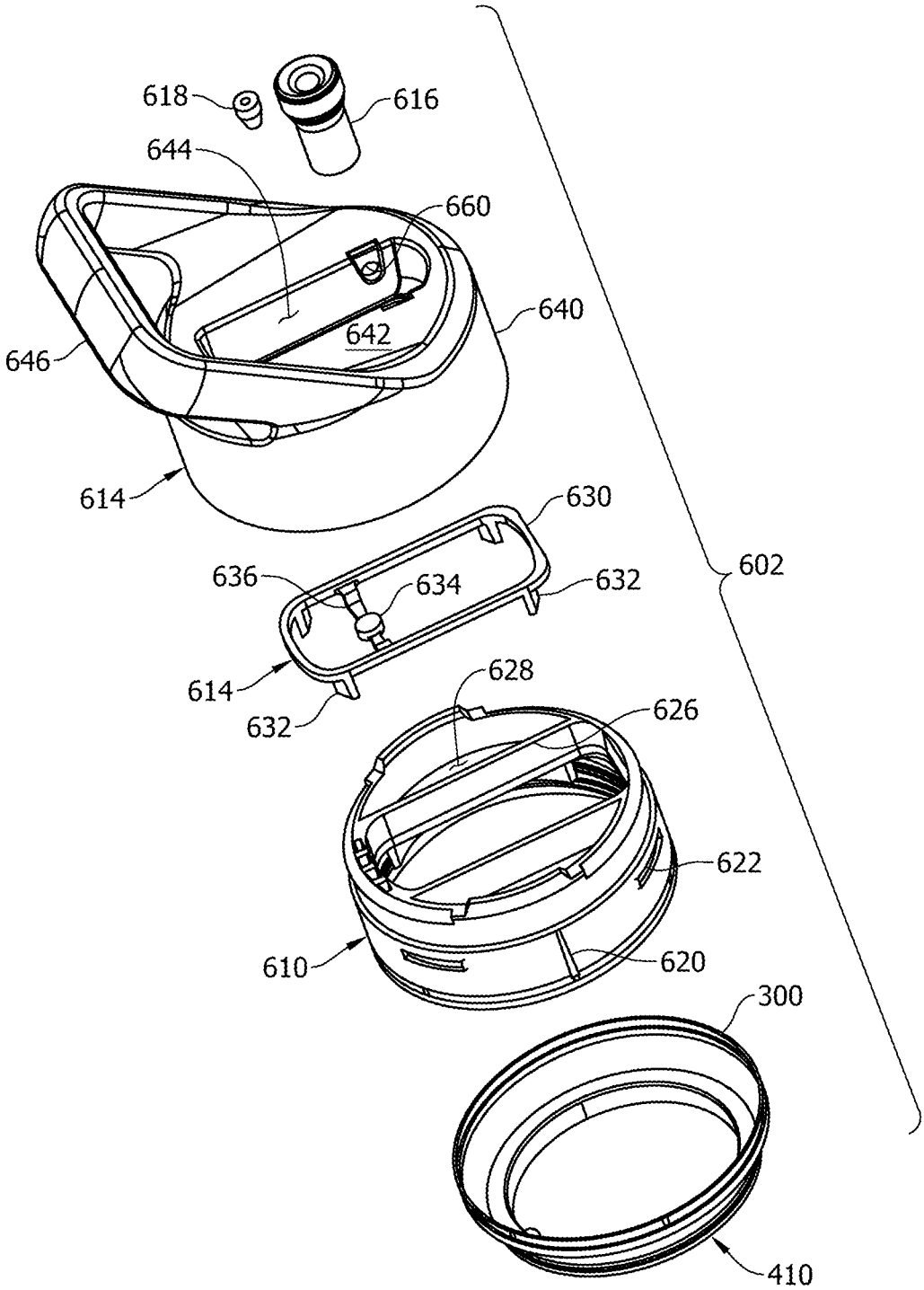
FIG. 22 is an alternative separated perspective of the head.

As shown in FIGS. 21 and 22, the head 602 consists of a seal ring 410, a rim 300, a connector insert, generally designated by 610, a shaped gasket, generally designated by 612, a cover 614, a straw connector, generally designated by 616, and a vent insert, generally designated by 618. The seal ring 410 is identical to that of the lower closure 400 of the wide-to-narrow-mouth closure 40. The rim 400 is identical to the rim of the wide-mouth closure 36. The connector insert 610 has an axial ridge 620 and arcuate bosses 622 on its outer surface and a connector element 624 on its inner surface similar to those of the wide-mouth closure 36. The connector insert 610 also includes a generally rectangular frame 626 extending upward from a top wall 628 The shaped gasket 612 includes a rectangular sealing body 630 matching the frame 626, four legs 632 adapted to maintain the position of the gasket on the frame, and a central button 634 held in position by a flexible ribbon 636 spanning the body. The cover 614 includes a sidewall 640, a top wall 642 having a spout receiver, generally designated by 644, and a handle 646. An inner surface of the sidewall 640 includes an axial groove 650 corresponding to the axial ridge 620 on the connector insert 610 and arcuate ridges 652 for engaging the arcuate grooves 622 on the connector insert. As shown in FIG. 22, the spout receiver 644 is sized and shaped for receiving the spout 604 when in the closed position. A pivot support 660 is formed on each sidewall of the receiver 644 for rotatably receiving the spout. As shown in FIG. 21, a straw connector opening 662, a vent insert opening 664, and a button port 666 extend through the bottom of the receiver 644. Channels 668 extend from the button port 666 for accommodating the ribbons 363. A recess 670 (FIG. 20) is provided around the upper end of the straw connector opening 662. The straw connector 616 mounts in the recess 670 and includes a socket 672 at its lower end in which the straw 600 is inserted. An upper surface of the straw connector 616 has a spherical seat 674 that engages the spout 604 in both its open and closed positions. The vent insert 618 is mounted in the vent insert opening 664. The vent insert 618 includes a vent hole 680 for allowing air to pass through the cover as fluid is removed from the bottle 34.

Figure 23:
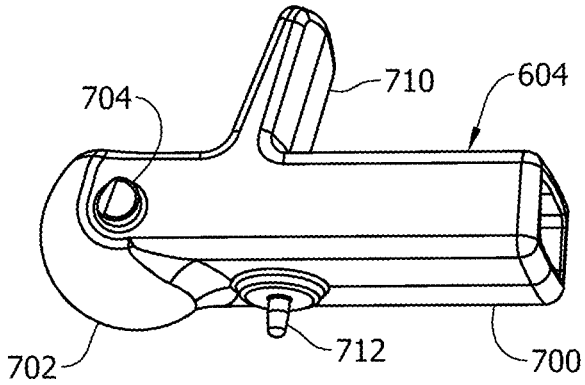
FIG. 23 is a perspective of a spout of the stowable straw closure.
Figure 24:
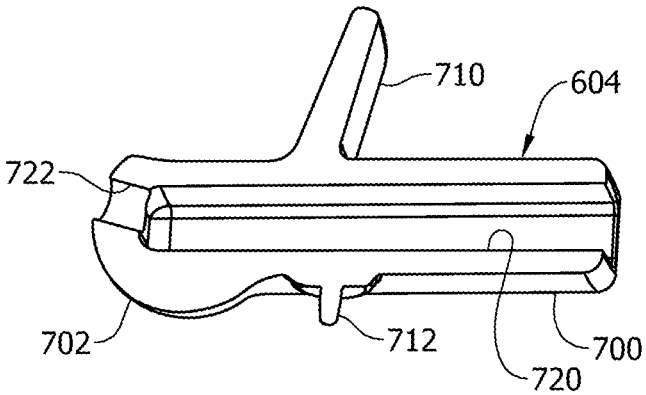
FIG. 24 is a vertical cross section of the perspective of FIG. 23.

As shown in FIGS. 23 and 24 the spout 604 includes a tube 700 having a spherical body 702 at one end and a short axle 704 extending outward from opposite sides of the spherical body. The axles 704 are adapted to be pivotally captured in the pivot supports 660, allowing the spout to pivot between its open and closed positions. When the axles 704 are positioned in the supports 660, the spherical body 702 seals against the spherical socket 674 of the straw connector. The axles 704 are aligned on an imaginary axis that passes through the center of the spherical body 702 so the body seals against the socket 674 over its entire range of motion. A lever 710 extends upward from the tube 700 permitting a user to pivot the spout 604 about its axles 704 from its closed position to its open position. A vent pin 712 extends downward from the tube. The pin 712 is positioned so it blocks the vent hole 680 in the vent insert 618 when the spout 604 is closed to prevent fluid from leaking through the hole. The pin 712 rotates out of the vent hole 680 as the spout 604 pivots toward the open position allowing pressure in the bottle 34 to equalize as fluid is removed from the bottle. The spout 604 includes a central passage 720 extending axially through the tube 700 and a connecting passage 722 extending from the central passage to the surface of the spherical body 702. When the spout 604 is pivoted to its open position as shown in FIG. 19, the connecting passage 722 aligns with an opening in the straw connector 616 so the central passage 720 in the tube 700 is in fluid communication with the passage in the straw 600. When the spout 604 is pivoted to its closed position as shown in FIG. 20, the connecting passage 722 is out of alignment with the opening in the straw connector so the central passage 720 in the tube 700 is not in fluid communication with the passage in the straw 600.

The button 634 seats inside the button port 666 and the ribbons 636 supporting the button rest in the channels 668 extending from the button port. A user may push the button 634 downward out of the opening to equalize pressure in the bottle 34 with ambient air. When a bottle 34 is used at a range of altitudes, pressure differentials between air inside the bottle and ambient air may hamper normal operation. A user can equalize the pressure by pushing the button 634 downward into the bottle. The elasticity of the ribbon 636 returns the button 634 to its nominal position blocking the button port 666. The handle 646 angles away from the spout 604 when open so the handle does not contact a user's nose when the user's mouth is on the spout.

Figure 25:
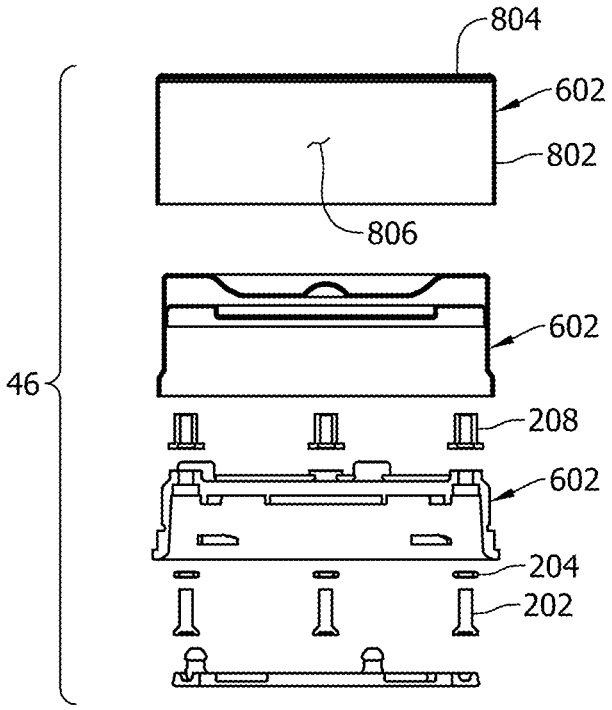
FIG. 25 is a separated cross section of a canister cap.

Returning to FIG. 1, a fourth exemplary configuration and combination 30*d* of the container system 30 is shown, consisting of the bottom canister 32 and the canister cap 46. FIG. 25 illustrates a cross section of the canister cap 46 comprising a seal ring 200 (not shown), connector insert 202, a gasket 204, a retainer 206, and a shell, generally designated by 800. The seal ring 200, connector 202, gasket 204, and retainer 206 are substantially identical to those previously described with respect to the bottle 34. The shell 800 includes a sidewall 802 and a top wall 804 defining a space 806 for receiving the retainer 206, the gasket 204, the connector insert 202, and the seal ring 200 during assembly. Although the shell may be made from other materials, the illustrated shell 800 is formed from SUS304 stainless steel. As the other features and assembly are similar to those previously described, they will not be described in further detail.

In addition to the components described above, it is envisioned that bottles having different lengths may be offered. Because the design modifications necessary to create these alternative bottles should be understood, no further description of these bottles will be provided.

As will be appreciated multiple different components of the container system 30 may be selectively combined to provide different configurations and combinations specifically adapted for the specific needs of users.

In view of the above, it will be seen that the several objects of the invention are achieved, and other advantageous results are attained.

When introducing elements of the present invention or the preferred embodiment(s) thereof, the articles "a", "an", "the", and "said" are intended to mean that there are one or more of the elements. The terms "comprising", "including", and "having" are intended to be inclusive and mean that there may be additional elements other than the listed elements.

The invention claimed is:

1. A reconfigurable container system, comprising:

a bottle including:

a) a bottle inner wall having a bottle inner wall upper end defining a bottle opening and a bottle inner wall lower end opposite the bottle inner wall upper end;

b) a bottle bottom wall extending across the bottle inner wall lower end such that the bottle inner wall and the bottle bottom wall define a bottle hollow interior adapted to hold liquid;

c) a bottle outer wall spaced from the bottle inner wall including a bottle outer wall upper end having a circular rim adjacent to a bottle screw connector element and a bottle outer wall lower end opposite to the bottle outer wall upper end extending below the bottle inner wall lower end thereby defining a space below the bottle bottom wall;

d) a bottle outer retainer mounted in the space below the bottle bottom wall and spaced from the bottle bottom wall;

e) a bottle inner retainer mounted inside the bottle outer retainer; and f) a bottle connector insert mounted below the bottle inner retainer, said bottle connector insert including a bottle connector insert inward-facing surface having a bottle bayonet connector element and a bottle connector insert downward-facing surface having an annular seal ring;

a closure including:

a) a closure outer wall having a closure screw connector element configured to releasably connect to the bottle screw connector element to selectively join the closure and the bottle; and b) a seal positioned to engage the bottle outer wall upper end when the closure screw connector element connects to the bottle screw connector element to block the bottle opening so as to retain liquid in the bottle hollow interior; and a bottom canister including:

a) a bottom canister collar having a bottom canister collar inner surface defining a bottom canister mouth and a bottom canister collar outer surface facing opposite the bottom canister collar inner surface;

b) a bottom canister hollow interior accessible through the bottom canister mouth and adapted for holding contents; and c) a bottom canister bayonet connector element positioned on the bottom canister collar outer surface and configured to releasably connect to the bottle bayonet connector element to selectively join the bottom canister and the bottle such that the bottom canister sealingly engages the annular seal ring on the bottle to retain contents in the bottom canister hollow interior.

2. A reconfigurable container system as set forth in claim 1, wherein the closure is selected from a group of closures consisting of a wide-mouth closure, a wide-and-narrow-mouth closure, and a stowable straw closure.

3. A reconfigurable container system as set forth in claim 2, wherein the lid comprises a lid side wall adapted for removable insertion in the bottom canister mouth, a lid bottom wall extending across the lid side wall, a flange positioned to engage the bottom canister collar when the lid side wall is inserted in the bottom canister mouth, and tab extending inward from the lid side wall and spaced from the lid bottom wall for removing the lid from the bottom container mouth.

4. A reconfigurable container system as set forth in claim 1, wherein the closure comprises a wide-mouth closure, and the system further comprises:

a wide-and-narrow-mouth closure; and a stowable straw closure.

5. A reconfigurable container system as set forth in claim 1, wherein:

the closure includes:

a) a cover;

b) a bail extending from the cover having a clockwise face and a counter-clockwise face opposite the clockwise face;

c) a clockwise-facing fillet joining the clockwise face of the bail to the cover; and d) a counter-clockwise-facing fillet joining the counter-clockwise face to the cover;

the counter-clockwise-facing fillet has a first radius; and the clockwise-facing fillet has a second radius that is larger than the first radius.

6. A reconfigurable container system as set forth in claim 1, further comprising a lid adapted to selectively block the bottom canister mouth so that contents in the bottom canister hollow interior are isolated from the bottle connector insert.

7. A reconfigurable container system as set forth in claim 1, further comprising a cap including:

a shell; and a cap insert mounted in the shell including a cap insert inward-facing surface having a cap insert bayonet connector element and a cap insert downward-facing surface having a cap annular seal ring; and wherein the cap insert bayonet connector element is configured to releasably connect to the bottom canister bayonet connector element to selectively join the cap and the bottom canister when the bottle is separated from the bottom canister to retain contents in the bottom canister hollow interior.

8. A reconfigurable container system as set forth in claim 1, further comprising an intermediate canister, including:

an intermediate canister collar having an intermediate canister collar inner surface defining an intermediate canister mouth and an intermediate canister collar outer surface facing opposite the intermediate canister collar inner surface;

an intermediate canister hollow interior accessible through the intermediate canister mouth and adapted for holding contents;

an intermediate canister upper bayonet connector element positioned on the intermediate canister collar outer surface and configured to releasably connect to the bottle bayonet connector element to selectively join the intermediate canister and the bottle such that the intermediate canister sealingly engages the annular seal ring on the bottle to retain contents in the intermediate canister hollow interior; and an intermediate canister downward-facing surface and an intermediate canister inward-facing surface below the intermediate canister hollow interior, the intermediate canister downward-facing surface having an intermediate canister annular seal ring and the intermediate canister inward-facing surface having an intermediate canister lower bayonet connector element configured to releasably connect to the bottom canister bayonet connector element to selectively join the bottom canister and the intermediate canister such that the bottom canister sealingly engages the intermediate canister annular seal ring to retain contents in the bottom canister hollow interior; and wherein the intermediate canister is selectively usable in combination with the bottle, the closure, and the bottom canister; and wherein the bottle, the closure, and the bottom canister are selectively usable without the intermediate canister.

9. A reconfigurable container system as set forth in claim 8, wherein:

the bottom canister has a first height measured between the bottom canister collar and a bottom canister lower end opposite the bottom canister collar;

the intermediate canister has a second height measured between the intermediate canister collar and an intermediate canister lower end opposite the intermediate canister collar; and the second height is a whole number multiple of the first length.

10. A reconfigurable container system as set forth in claim 9, wherein the first length and the second length are equal.

11. A reconfigurable container system as set forth in claim 8, wherein:

the bottle includes a cylindrical bottle outer surface having a first diameter;

the closure includes a cylindrical closure outer surface having a second diameter equal to the first diameter;

the intermediate canister includes a cylindrical intermediate canister outer surface having a third diameter equal to the first diameter and the second diameter; and the bottom canister includes a cylindrical bottom canister outer surface having a fourth diameter equal to the first diameter, the second diameter, and the third diameter.

12. A reconfigurable container system as set forth in claim 1, wherein:

the bottle includes a cylindrical bottle outer surface having a first diameter;

the closure includes a cylindrical closure outer surface having a diameter equal to the first diameter; and a hollow bottle interior adapted to hold liquid therein.

13. A reconfigurable container system, comprising:

a thermally insulated bottle including a plurality of walls, a hollow bottle interior adapted to hold liquid therein, an outward-facing bottle screw connector element adjacent to a bottle upper end, an inward-facing bottle bayonet connector element, and a selectively removable elastomeric bottle seal ring positioned adjacent to the inward-facing bottle bayonet connector element;

a closure including an inward-facing closure screw connector element configured to releasably interlock with the outward-facing bottle screw connector element to selectively connect the closure to the bottle and a seal positioned to engage the bottle when the inward-facing closure screw connector element interlocks with the outward-facing bottle screw connector element to retain liquid in the bottle hollow interior;

an intermediate canister having an intermediate canister hollow interior and an outward-facing intermediate canister upper bayonet connector element configured to releasably interlock with the inward-facing bottle bayonet connector element to selectively join the intermediate canister and the bottle so the outward-facing intermediate canister bayonet connector element directly contacts the inward-facing bottle bayonet connector element without intervening connector elements and the intermediate canister engages the elastomeric bottle seal ring to retain contents in the intermediate canister hollow interior, said intermediate canister further including an inward-facing intermediate canister lower bayonet connector element and a selectively removable elastomeric intermediate canister seal ring positioned adjacent to the inward-facing intermediate canister lower bayonet connector element;

a bottom canister having a bottom canister hollow interior, a bottom canister collar defining a bottom canister circular mouth, and an outward-facing bottom canister bayonet connector element configured to releasably interlock with the inward-facing bottle bayonet connector element to selectively join the bottom canister and the bottle so the outward-facing intermediate canister bayonet connector element directly contacts the inward-facing bottle bayonet connector element without intervening connector elements and the intermediate canister engages the elastomeric bottle seal ring to retain contents in the bottom canister hollow interior and to releasably interlock with the inward-facing intermediate canister lower bayonet connector element to selectively join the bottom canister and the intermediate canister so the outward-facing bottom canister bayonet connector element directly contacts the inward-facing intermediate canister lower bayonet connector element without intervening connector elements and the bottom canister engages the elastomeric intermediate canister seal ring to retain contents in the bottom canister hollow interior; and a cap including an inward-facing cap bayonet connector element configured to releasably interlock with the outward-facing bottom canister bayonet connector element to selectively join the cap and the bottom canister so the outward-facing bottom canister bayonet connector element directly contacts the inward-facing cap bayonet connector element without intervening connector elements to retain contents in the bottom canister hollow interior and to releasably interlock with the outward-facing intermediate canister upper bayonet connector element to selectively join the cap and the intermediate canister so the outward-facing intermediate canister bayonet connector element directly contacts the inward-facing cap bayonet connector element without intervening connector elements to retain contents in the intermediate canister hollow interior; and wherein the cap and bottom canister are adapted for use without the bottle, the closure, and the intermediate canister;

wherein the cap, the intermediate canister, and the bottom canister are adapted for use without the bottle and the closure;

wherein the bottle, the closure, the intermediate canister, and the bottom canister are adapted for use without the cap; and wherein the bottle, the closure, and the bottom canister are adapted for use without the intermediate canister and the cap.

14. A reconfigurable container system as set forth in claim 13, wherein the bottle has a cylindrical outer surface having a preselected diameter, the closure has a cylindrical outer surface having a diameter equal to that of the cylindrical outer surface of the bottle, the intermediate canister has a cylindrical outer surface having a diameter equal to those of the cylindrical outer surface of the bottle and the cylindrical outer surface of the closure, and the bottom canister has a cylindrical outer surface having a diameter equal to those of the cylindrical outer surface of the bottle, the cylindrical outer surface of the closure and the cylindrical outer surface of the intermediate canister.

15. A reconfigurable container system as set forth in claim 13, wherein the closure is selected from a group of closures consisting of a wide-mouth closure, a wide-and-narrow-mouth closure, and a stowable straw closure.

16. A reconfigurable container system as set forth in claim 13, wherein the closure comprises a wide-mouth closure, and the system further comprises:

a wide-and-narrow-mouth closure; and a stowable straw closure.

17. A reconfigurable container system as set forth in claim 16, wherein the bottle has a cylindrical outer surface having a preselected diameter, the wide-mouth closure has a cylindrical outer surface having a diameter equal to that of the cylindrical outer surface of the bottle, the wide-and-narrow-mouth closure has a cylindrical outer surface having a diameter equal to that of the cylindrical outer surface of the bottle, the stowable straw closure has a cylindrical outer surface having a diameter equal to that of the cylindrical outer surface of the bottle, the intermediate canister has a cylindrical outer surface having a diameter equal to those of the cylindrical outer surface of the bottle, and the bottom canister has a cylindrical outer surface having a diameter equal to those of the cylindrical outer surface of the bottle and the cylindrical outer surface of the intermediate canister.

18. A reconfigurable container system as set forth in claim 13, further comprising a lid adapted to selectively block the bottom canister mouth.

* * * * *